United States Patent [19]

Gee

[11] 4,411,642

[45] Oct. 25, 1983

[54] CARTON-ERECTING MACHINE

[75] Inventor: Minor E. Gee, Sanger, Calif.

[73] Assignee: Maxco Supply, Inc., Reedley, Calif.

[21] Appl. No.: 204,201

[22] Filed: Nov. 5, 1980

[51] Int. Cl.[3] ..... B31B 1/80; B31B 5/00

[52] U.S. Cl. ..... 493/125; 493/131; 493/183

[58] Field of Search ..... 493/122, 123, 125, 131, 493/177, 178, 183; 198/487, 748; 53/374

[56] References Cited

U.S. PATENT DOCUMENTS

| | | | |
|---|---|---|---|
| Re. 30,921 | 5/1982 | McDowell | 493/131 |
| 3,554,364 | 1/1971 | Lane | 198/748 |
| 3,982,474 | 9/1976 | Klund | 493/183 |
| 4,160,406 | 7/1979 | Nowacki | 493/125 |
| 4,218,862 | 8/1980 | Marchetti | 53/374 |
| 4,285,682 | 8/1981 | Moss | 493/183 |
| 4,331,435 | 5/1982 | Nowacki | 493/178 |

*Primary Examiner*—Nicholas P. Godici
*Assistant Examiner*—Marc Hodak
*Attorney, Agent, or Firm*—Huebner & Worrel

[57] ABSTRACT

The invention is embodied in a high-speed case-erecting machine characterized by a bottom-feed hopper, a pneumatic picker and a pair of live transfer rollers for transferring from the hopper flattened, knocked-down cases to be received at a case-squaring station equipped with vertically separable pneumatic cups for squaring the cases, a chain-driven, reciprocating conveyor of adjustable modular construction for transferring squared cases through a series of flap-manipulating stations at which the flaps located at one end of each case are closed and sealed, thus to provide a series of erected cases.

7 Claims, 55 Drawing Figures

88
96
98
84
30a
82
33
90
48
46
32
38
30 b
56
54
34
42
40
200
202
28a
16
52
104
196
204
206
208
184
188
182
100
194
198
190
192
186
180
44
210
108
214
12
400
402
404
386
384 b
18b
14
386'

22
23
21
18a
214a
214b
306a
306b
322
322a
322b
324a
324b
325a
325b
326
328
330
332
334
336
338
339
340
342a
342b
344
346a
346b
350
352
356
430
296
300'
301
302
304
308
310
310a
310b
312'
314
316
318
320
384a
387
387'
388
390
392
394
396
378'

C
16
MP1
MF1
218
216
LP
LF
14
290
TP
TF
276
MF2
MP2
20
370
292
434
22
24
26

CARTON-ERECTING MACHINE

BACKGROUND OF THE INVENTION

The invention generally relates to machines for use in setting-up, or erecting, so-called knocked-down cases, also referred to in the industry as articulated carton blanks. Hence, the terms, cartons and case, and case-erecting, carton-erecting and case-squaring, are herein employed synonymously.

Briefly, the knocked-down cases herein referred to are of conventional design and include a pair of major panels interconnected by a pair of minor panels which, when expanded, or squared, define a generally rectangular interior. From at least one end of each expanded, knocked-down case, there is projected a plurality of flaps adapted to be manipulated for closing the case, when expanded, thus to form an erected case. For example, from opposed major panels there extends a pair of major flaps, and from opposed minor panels there extends a pair of minor flaps. The flaps are articulated along transverse score lines and thus are adapted readily to be manipulated or broken and/or in-folded about axes extending along the edges of the panels from which the flaps project for purposes of closing the case at one end thereof. Thus the knocked-down cases are erected, or set up. The erected cases now are in a condition to be delivered from the case-erecting stations of the machine to the other stations, machines, etc., such as case-filling and closing stations, machines, etc., at which additional operations are performed.

DESCRIPTION OF THE PRIOR ART

The prior art is replete with machines adapted to perform case-erecting operations for knocked-down cases of the class hereinbefore generally described. However, it is believed that the most closely related prior art patent is U.S. Pat. No. 4,170,929 which issued Oct. 16, 1979 to James E. McDowell. This patent generally discloses an apparatus for erecting or setting-up folded cartons or knocked-down cases and is provided with a carton-squaring station, flap manipulation stations, a glue applicator, and a compression station for completing erection of knocked-down cases. However, it is generally recognized that the patented machine simply fails to meet existing needs.

In the industry, efforts continuously are being made to improve machine performance and endurance, as well as to enhance the over-all efficiency and speeds for machines of the class to which the aforementioned patented case-erecting machine belongs. For example, it is a well recognized principle of machine design that operational speeds should be increased in order to increase the total output or operational efficiency of the machine. In attempting to increase the operational speeds of machines of the type hereinbefore mentioned, however, it is imperative that the knocked-down cases, or blanks, be handled in a manner which insures the integrity thereof, while rapid manipulation and case erection is yet facilitated.

It is believed to be apparent to those familiar with the requirements of the industry that existing machines, such as the aforementioned patented machine, fail fully to satisfy existing needs.

Accordingly, it is the general purpose of the instant invention to provide an improved case-erecting machine for erecting flattened, knocked-down cases, preparatory to filling, at increased speeds, with enhanced efficiency, durability and safety, all without substantially increasing production and operational costs.

OBJECTS AND SUMMARY OF THE INVENTION

It is an object of the instant invention to provide an improved, case-erecting machine.

Another object is to provide in a case-erecting machine, improved subassemblies having a capability for enhancing operational speeds and efficiency of the machine.

Another object is to provide in a case-erecting machine, an improved mechanism for feeding knocked-down cases.

Another object is to provide in a case-erecting machine, an improved mechanism for erecting flattened, knocked-down cases into horizontally open cases, preparatory to filling.

Another object is to provide in a case-erecting machine an improved case-picking mechanism for picking knocked-down cases from a supply stack in combination with an improved case-transfer mechanism, case-squaring mechanism, and an improved case-closing mechanism.

Another object is to provide in a case-erecting machine, an improved case-picking and case-transfer mechanism for increasing speed and efficiency in feeding the machine.

Another object is to provide in a case-erecting machine, an improved striker assembly particularly adapted to manipulate the trailing flap of expanded, open-end cases, at a case-squaring station, with increased efficiency.

Another object is to provide in combination with a carton-erecting mechanism, improved mechanisms for manipulating case flaps in case-erecting operations.

These and other objects and advantages are achieved through the use of a case-erecting machine particularly suited for erecting flattened, knocked-down cases into horizontally open cases preparatory to filling, means defining a case-squaring station having means for receiving flattened, knocked-down cases and vertically separable, pneumatic cups for engaging and vertically expanding the received, knocked-down cases into expanded or squared cases of open-end configurations, a bottom-feed hopper for supporting a stack of horizontally oriented, flattened, knocked-down cases, a case-picker and case-transfer mechanism for transferring the knocked-down cases from the hopper to the case-squaring station, including horizontally oriented nip rollers forming case feed rollers arranged in a substantially vertically oriented plane and interposed between the hopper and the case-squaring station for serially transferring thereto flattened, knocked-down cases, flap-manipulating stations adjacent said case-squaring station at which case-closing operations are performed, glue applicator and compression stations at which glue is applied to the flaps and the flaps are sealed together with an improved case-conveyor for serially advancing the cases through the machine from the case-squaring station through the compression station, as will become more readily apparent by reference to the following description and claims in light of the accompanying drawings.

DESCRIPTIONS OF THE DRAWINGS

FIG. 32 is a vertically sectioned view taken generaly along lines 32—32 of FIG. 31.

Figures 48, 48A, 48B, 48C, 48D, 48E, 48F:
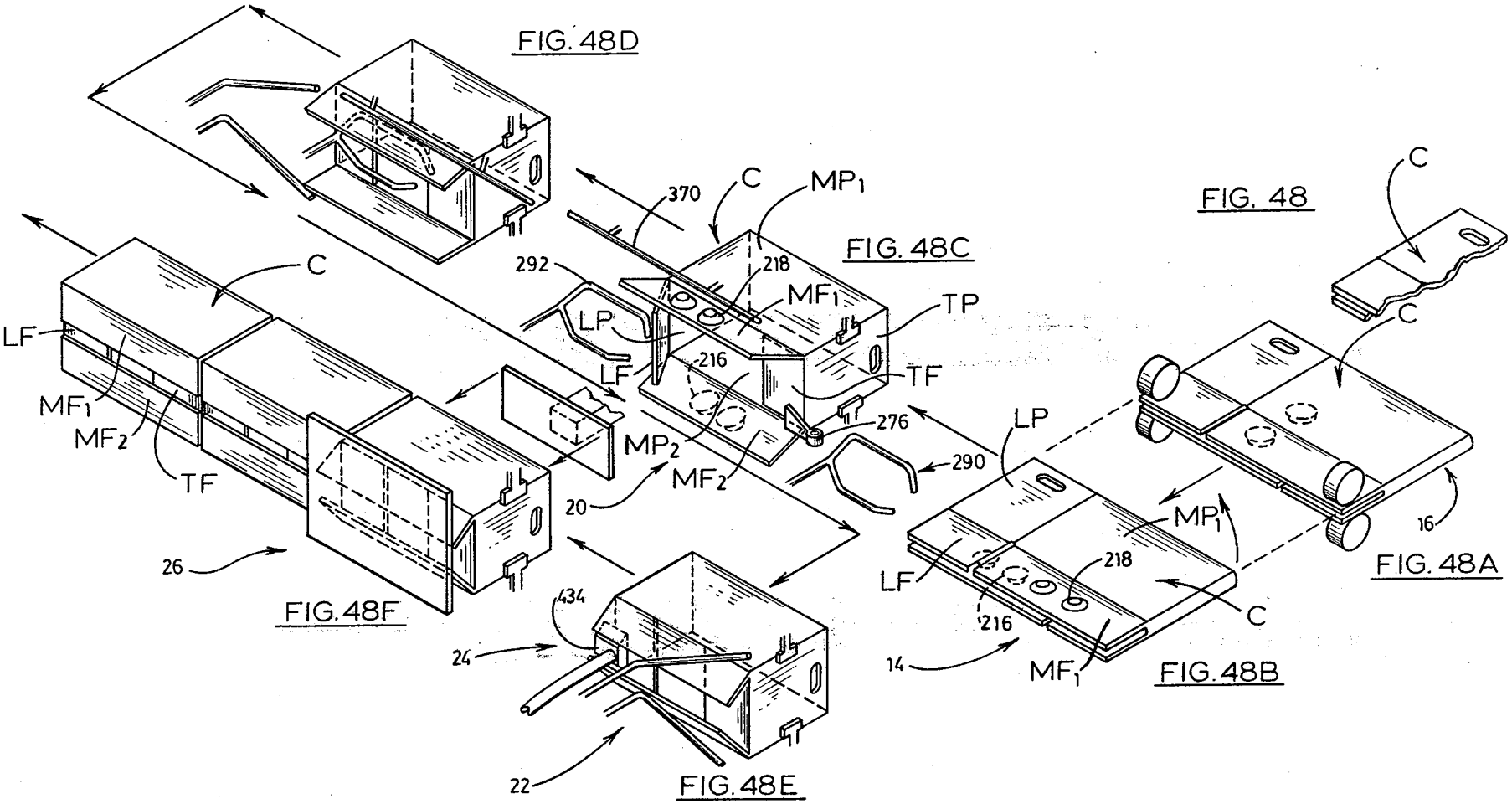

FIGS. 48-48F collectively illustrate a case-erecting operation, as performed by the case-erecting machine which embodies the principles of the instant invention.

Figure 49:
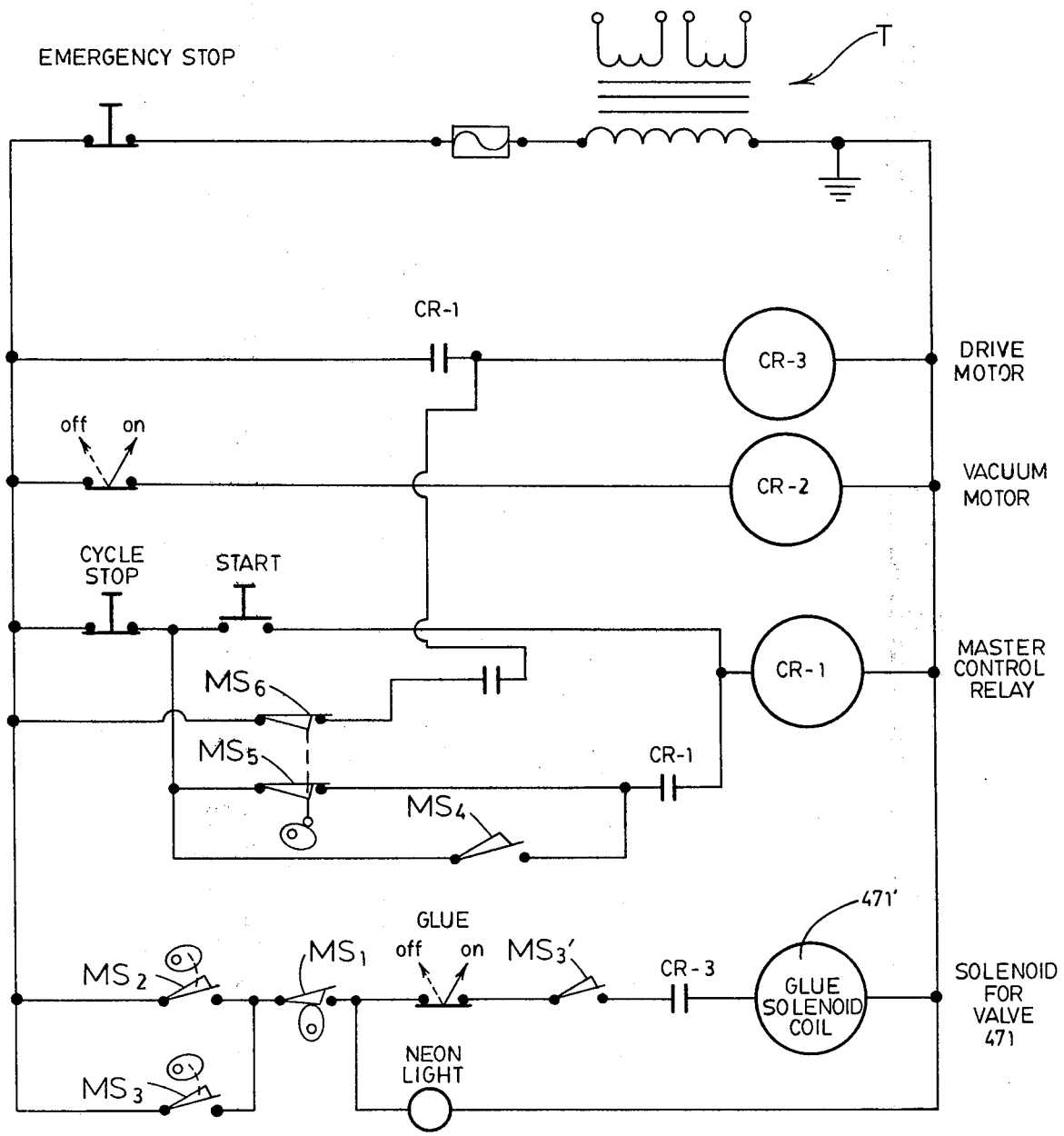

FIG. 49 is a simplified, diagrammatic view of an electrical system provided for controlling and powering the machine.

Figures 6, 12, 50:
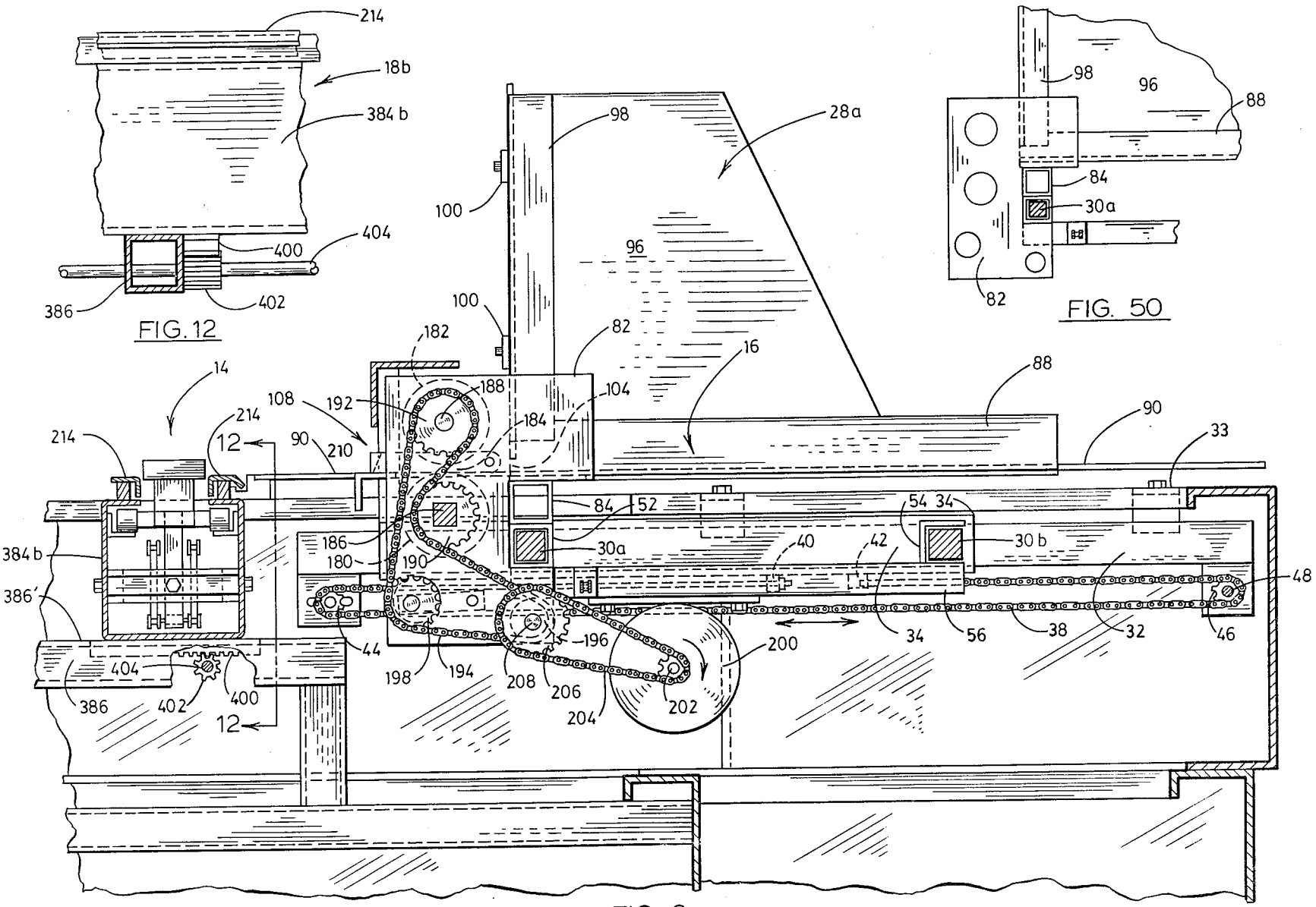
FIG. 6 is a sectional view taken generally along lines 6—6 of FIG. 5.
FIG. 12 is a fragmented, partially sectioned view taken generally along lines 12—12 of FIG. 10.

FIG. 50 is a fragmented, side-elevational view of the mounting for the hopper.

DESCRIPTION OF THE PREFERRED EMBODIMENT

(General Description)

Figure 1:
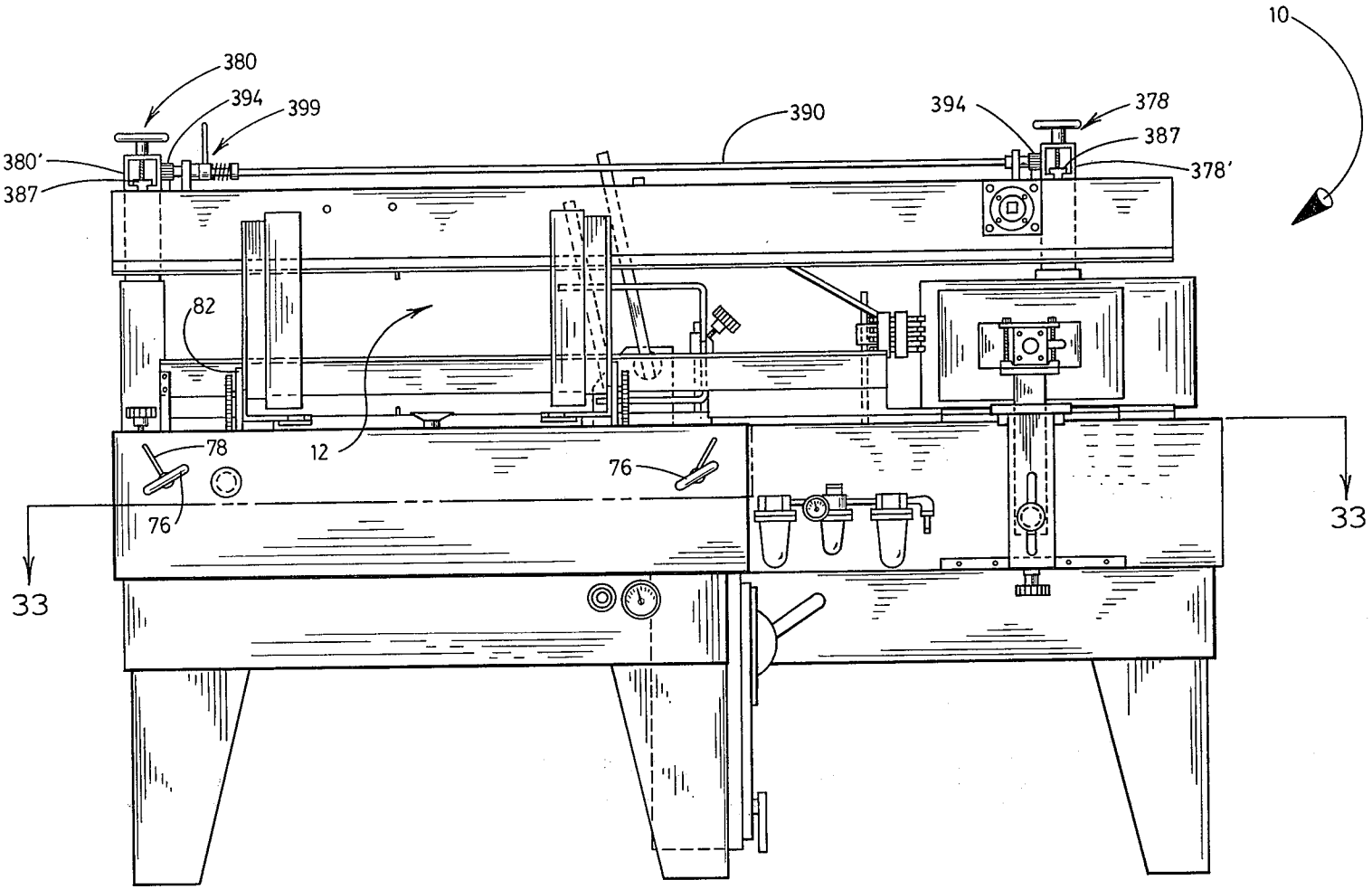
FIG. 1 is a front elevational view of a machine embodying the principles of the instant invention.

Referring now to the drawings, with more particularity, wherein like reference characters designate like or corresponding parts throughout the several views, therein is shown, in FIG. 1, a machine, generally desiganted 10, embodying the principles of the instant invention.

The machine 10, as shown, is provided with a suitable frame, not designated, the component members thereof collectively being designated F. Mounted on the frame is a case hopper, FIG. 4, generally designated 12, which serves to receive a stack of cases C in knocked-down or collapsed configurations, see FIG. 48. Each of the cases C, as best illustrated in FIGS. 48*a*–48*f*, comprises an articulated structure and includes a first major panel $MP_1$ having projected therefrom an articulated major flap $MF_1$; a second major panel $MP_2$ having projected therefrom a second major flap $MF_2$; a first panel interconnecting the major panels, herein referred to as a leading panel, designated LP, having projected therefrom a leading flap LF; and a second interconnecting panel, herein referred to as a trailing panel, designated TP, having projected therefrom a trailing flap TF.

The cases C are transferred from the hopper to a case-squaring station at which the cases are "squared" or expanded in initial steps of case-erecting operations, as performed by the machine. It is important to note that the cases C are expanded at the case-squaring station into expanded, tubular, open-end configurations preparatory to having the extended flaps thereof manipulated or in-folded and sealed thus to provide a completed or erected case.

In order to effect a transfer of the knocked-down cases from the hopper 12 to the case-squaring station 14, the machine 10 is provided with a case-transfer station, generally designated 16. The function and purpose of the station 16 first is to pick the bottom-most case from the stack supported by the hopper 12, then feed or transfer the case to the case-squaring station 14.

At the case-squaring station 14, each case C is squared or expanded from its collapsed configuration, FIG. 48B, to an open-end configuration, best illustrated in FIG. 48C as a case-erecting operation is initiated.

Figure 3:
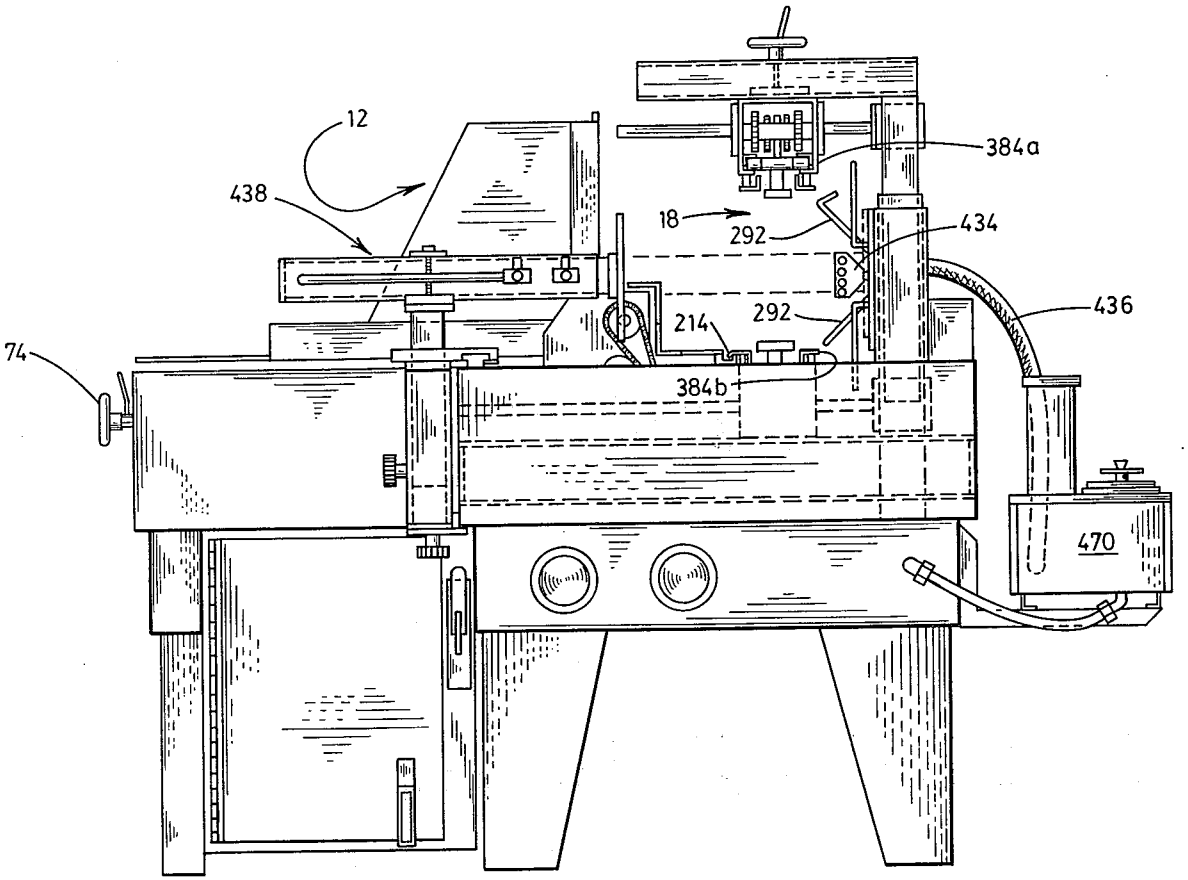
FIG. 3 is an end elevational view of the machine.

Concurrently with the expansion of each knocked-down case to an expanded case of an open-end configuration, initial steps in a case-closing operation are initiated. As illustrated in FIG. 48C, initially the major flaps $MF_1$ and $MF_2$ are broken in a direction projected away from the interior of the case C, while the leading flap LF and the trailing flap TF are in-folded. Subsequently, each case C is transferred via a case-conveyor, generally designated 18, FIG. 3, through a minor flap-folding station 20, at which minor flap-folding operations are completed, and thence to a major flap-folding station 22, at which the major flaps are folded into interfering relation with the minor flaps. The case C is next advanced to a glue applicator station 24, at which a film of glue is interposed between the opposed surfaces of the major and minor flaps, and thence to a compression station, generally designated 26, at which the heretofore manipulated flaps are caused to assume superimposed and coplanar relationships. This series of flap-manipulating operations is best illustrated in FIGS. 48C–48F. In summary, it should now be apparent that the knocked-down cases C, fed from the hopper 12 to the case-squaring station 14, initially are expanded into open-end configurations at the station 14 and, concurrently, the flaps LF and TF are infolded; next, at station 20, the folding of the minor flaps LF and TF is completed; at station 22, the major flaps are folded into an interfering relation with the leading and trailing flaps LF and TF, respectively, and glue is applied to the surfaces of the over-folded flaps $MF_1$, $MF_2$, LF and TF, at station 24, as the cases exit station 22; the flaps $MF_1$ and $MF_2$ are next forced into a contiguous relation with the leading and trailing flaps and sealed in mutually coplanar relation, at the compression station 26. The cases C are advanced from the case-squaring station 14 through the various stations, aforementioned, as it moves through the machine by the case-conveyor 18.

(Hopper)

Figure 15:
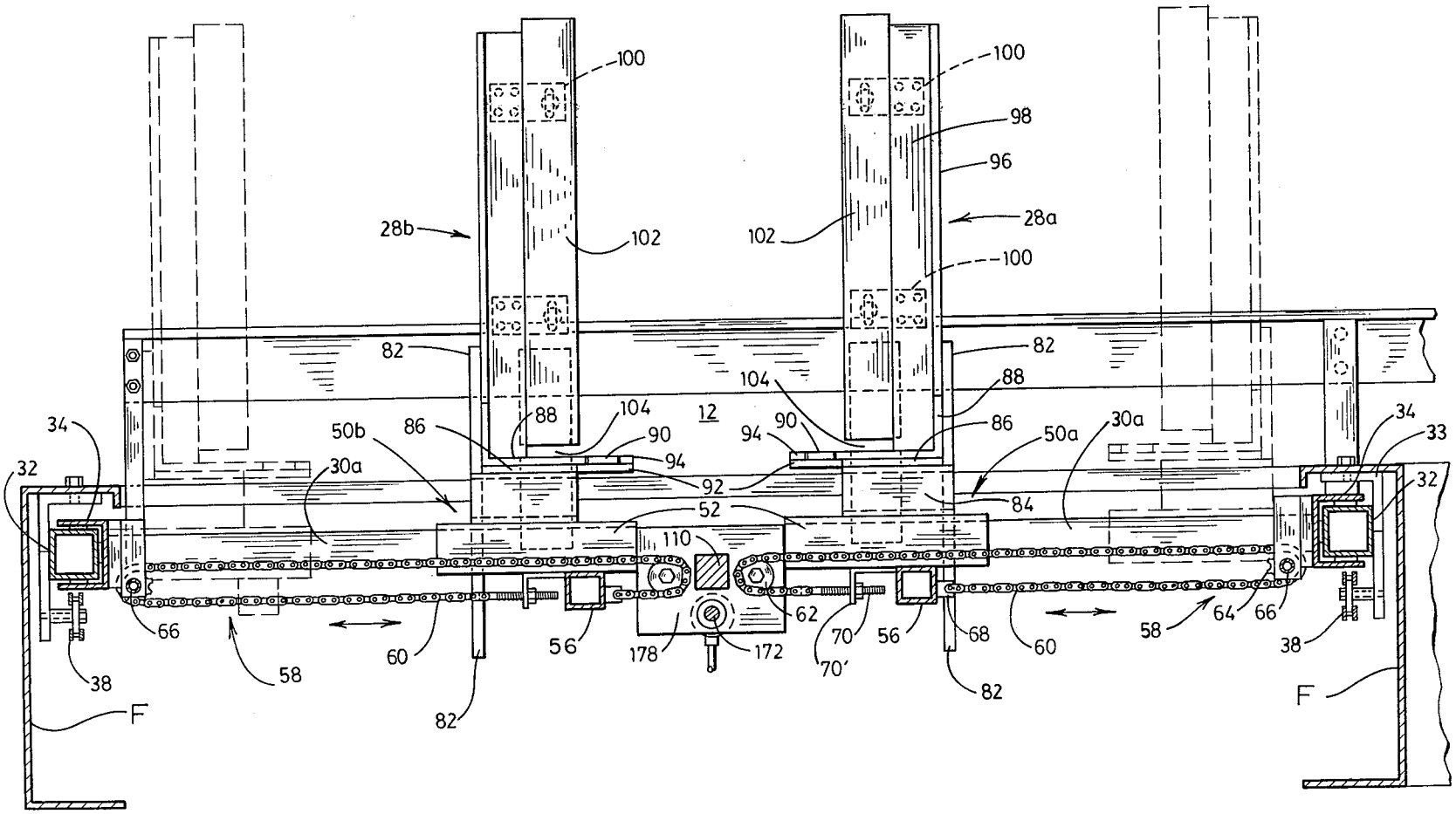
FIG. 15 is a vertically sectioned view of the case hopper for the machine taken generally along lines 15—15 of FIG. 5, with component parts of the machine being deleted for the sake of clarity and with the side assemblies of the hopper being shown in phantom at alternate positions.

The hopper 12, as best illustrated in FIG. 15, includes a pair of side assemblies 28*a* and 28*b*, supported for mutually opposed and mutually independent motion for purposes of accommodating width adjustment. Width adjustment is facilitated in order to enhance versatility in accommodating knocked-down cases of varying dimensions.

With reference to FIGS. 6 and 15, collectively, it can be seen that the hopper 12 is supported by a pair of transverse support rails 30*a* and 30*b*. These rails are, in turn, supported at their opposite ends for displacement along a pair of parallel support rails 32. The support rails 32 preferably are suspended from frame members, designated F, by brackets 33 bolted to the frame member. An elongated bearing 34 is welded to the rails 30*a* and 30*b*, at each of the opposite ends thereof, and slidably mounted on the support rails 32. The bearings 34 serve as couplings for slidably connecting the rails 30*a* and 30*b* to the support rails 32.

Figure 9:
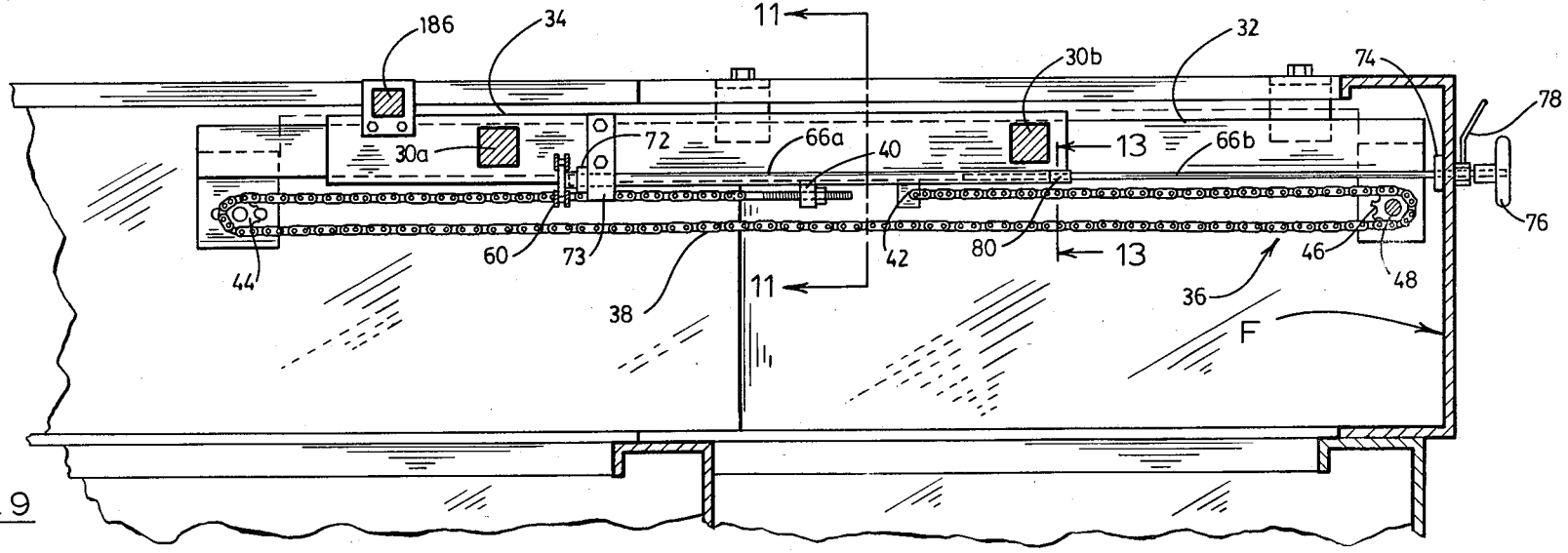
FIG. 9 is a fragmented, partially sectioned view, taken generally along lines 9—9 of FIG. 5.

In order to reposition the rails 30*a* and 30*b* along the rails 32, and thus reposition the hopper 12 in a direction paralleling the rails 32 and transversely with respect to the path of the conveyor 18, there is provided a positional adjustment drive, generally designated 36, FIG. 9. It is here noted that an adjustment drive 36 is provided for each bearing 34. As shown, each positional adjustment drive 36 includes a chain 38 having its opposite ends rigidly affixed to one of the bearing rails 34, at couplings 40 and 42, see FIG. 6.

Figure 4:
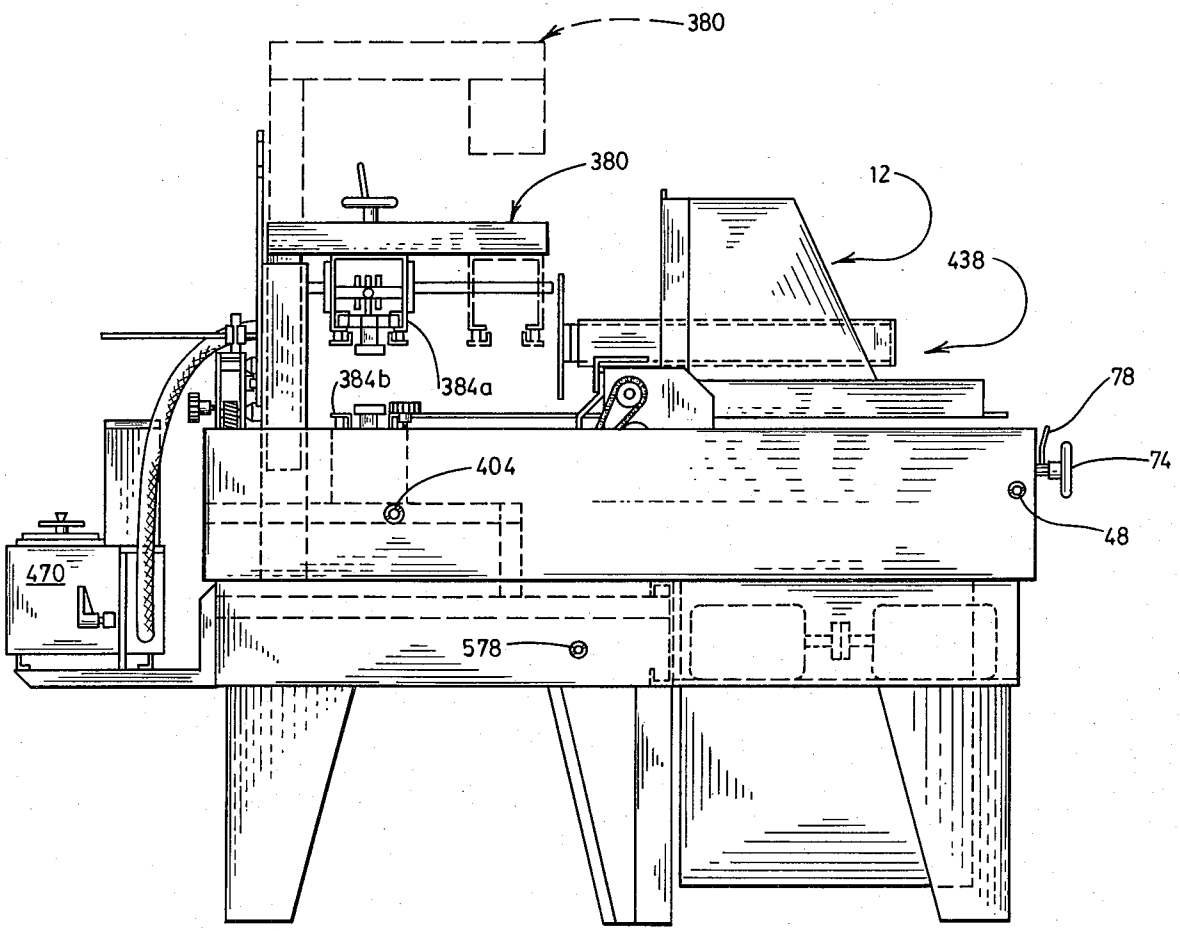
FIG. 4 is an end elevational view, taken oppositely with respect to the view shown in FIG. 3.

As shown in FIG. 9, the coupling 40, in effect, comprises a turn-buckle which serves to accommodate adjustment of tension in the chain 38, while the coupling 42 comprises a clevis connected to a bracket rigidly affixed to the bearing 34. Each of the chains 38 is trained about a pair of sprockets 44 and 46 supported by frame members F in fixed relation with the support rails 32. In practice, each sprocket 44 comprises a free-running sprocket, while each sprocket 46 comprises a drive sprocket mounted on a drive shaft 48. With reference to FIG. 4, it can be seen that the drive shaft 48 exits the machine in a position of access, the end thereof being adapted to accept a torque applicator, such as a T-handle, flat-and-socket coupling, or the like. In any event, through torque applied to the drive shaft 48, externally of the machine 10, rotation is imparted to the sprocket 46, whereupon the chain 38 responsively is advanced relative to the sprockets 44 and 46. This advancement causes the bearings 34 to slidingly advance along the surfaces of the rails 32.

At this juncture, it is again noted that in practice a chain 38 is provided for achieving positional adjustment for each of the bearings 34, as best shown in FIG. 15, and that the drive shaft 48 is common to the pair of sprockets 46, whereby the pair of chains 38 is driven simultaneously in response to rotation imparted to the shaft 48. Consequently, it can be appreciated that simply by rotating the shaft 48, in a proper direction, the hopper 12 is selectively advanced or retracted relative to the carton-squaring station 14 and conveyor 18.

The hopper 12 also includes a pair of side plate support assemblies, designated 50*a* and 50*b* of similar design, FIG. 15. Since these assemblies are of a common design, a detailed description of only one of the side plate support assemblies, namely 50*a*, is deemed adequate for providing for a complete understanding of the instant invention.

The assembly 50*a* includes a bearing 52, FIG. 15, mounted on and adapted to be slidingly displaced along the support rail 30*a*, while a similar bearing 54, FIG. 6, is provided to be advanced along the support rail 30*b*. With reference to FIG. 15, it is noted that in effect, each bearing 52 comprises a sleeve received by the support rail 30*a*, while the bearing 54, FIG. 6, comprises a hanger mounted to slide along the support rail 30*b*. A pair of mutually spaced coupling beams 56, only one of which is shown in FIG. 6, is provided for uniting the bearings 52 and 54 into a unitary configuration forming the side plate support assembly 50*a*.

In order to achieve lateral positional adjustment of the side plate support assemblies 50*a*, and 50*b*, each independently of the other, there is provided a drive assembly, generally designated 58, as best shown in FIG. 15 for each of the plate support assemblies. Since the drive assemblies are of a common design and perform similar functions, a description of a single one of the assemblies 58 is provided. This drive assembly includes a chain 60, FIG. 15, connected at each of its opposite ends to the coupling beam 56, in an opposed relation, and trained about a bearing block 62 mounted on a support plate 64 and a sprocket 65. The bearing block is coupled to a bracket, to be described, while the sprocket 65 is supported by a drive shaft 66.

A suitable clevis 68 is provided for connecting the chain 60, at one end thereof, to the beam 56 while a turn-buckle coupling 70 is provided for connecting the opposite end of the chain 60 to the coupling beam 56, via a suitable bracket 70'. Hence, tension in the chain 60 readily may be adjusted at the turn-buckle.

The drive shaft 66, in turn, comprises a segmented drive shaft segment having a first shaft 66*a*, FIG. 9, supported at one end by a bearing 72, located adjacent to the sprocket 65 supported by a bracket 73. The shaft also includes a second segment 66*b* supported by a bearing 74 mounted on frame member F. The second segment 66*b* is extended through the bearing 74 and frame member F to receive a hand-wheel 76, provided for imparting torque to the drive shaft 66. A suitable cam lock 78 is provided for securing the drive shaft 66 against rotation. As a practical matter, a nipple 80, comprising an internally flattened nipple, is provided for accommodating a telescoping of the shaft segment 66*b* into the shaft segment 66*a* in order to accommodate positional changes of the hopper 12 relative to the case-squaring station 14. The nipple 80 is, where so desired, adapted to be secured once adjustment is achieved for the hopper.

It should now be apparent that simply by applying torque to the shafts 66, via the hand wheels 76, the side plate support assemblies 50*a* and 50*b* responsively are advanced along the rails 30*a* and 30*b* in a direction determined by the direction of the applied torque.

Referring again to FIGS. 6 and 15, collectively, it can be seen that for each side plate support assembly 50*a* and 50*b*, a mounting plate 82 is provided. This plate is extended above and below the beam 56. As a practical matter, the plates 82 are welded to the bearing 52 so as, in effect, to be rigidly affixed to and securely supported by the bearing, as shown in FIG. 15.

A spacer 84 comprising a box extrusion is seated on the bearing 52 and is rigidly affixed to the bearing 52 and plate 82, as by welding or the like. Mounted, as by welding or the like to the upper surface of the spacer bar 84 is a plate 86, FIG. 15, on which is seated a right-angle extrusion forming a mounting plate 88. The plate 86, in effect, serves as a spacer plate for the plate 88. The plate 88, in turn, serves as a supporting guide rail for one side surface of a case-support strip 90, and is welded to the mounting plate 82.

The horizontal edge portion of the plate 86 is projected slightly beyond the adjacent edge of the plate 88 to provide a lip 92. The lip serves to engage the lower surface of the support strip 90 and confine the strip from beneath as well as to serve as a support for a further guide plate 94, affixed thereto and projected to serve as a lateral support surface or guide for the support strip 90. Thus the support strip is confined in an upwardly-opening slot, not designated, formed by the side surfaces of the plates 88 and 94, and the upper surface of the lip 92.

Figure 5:
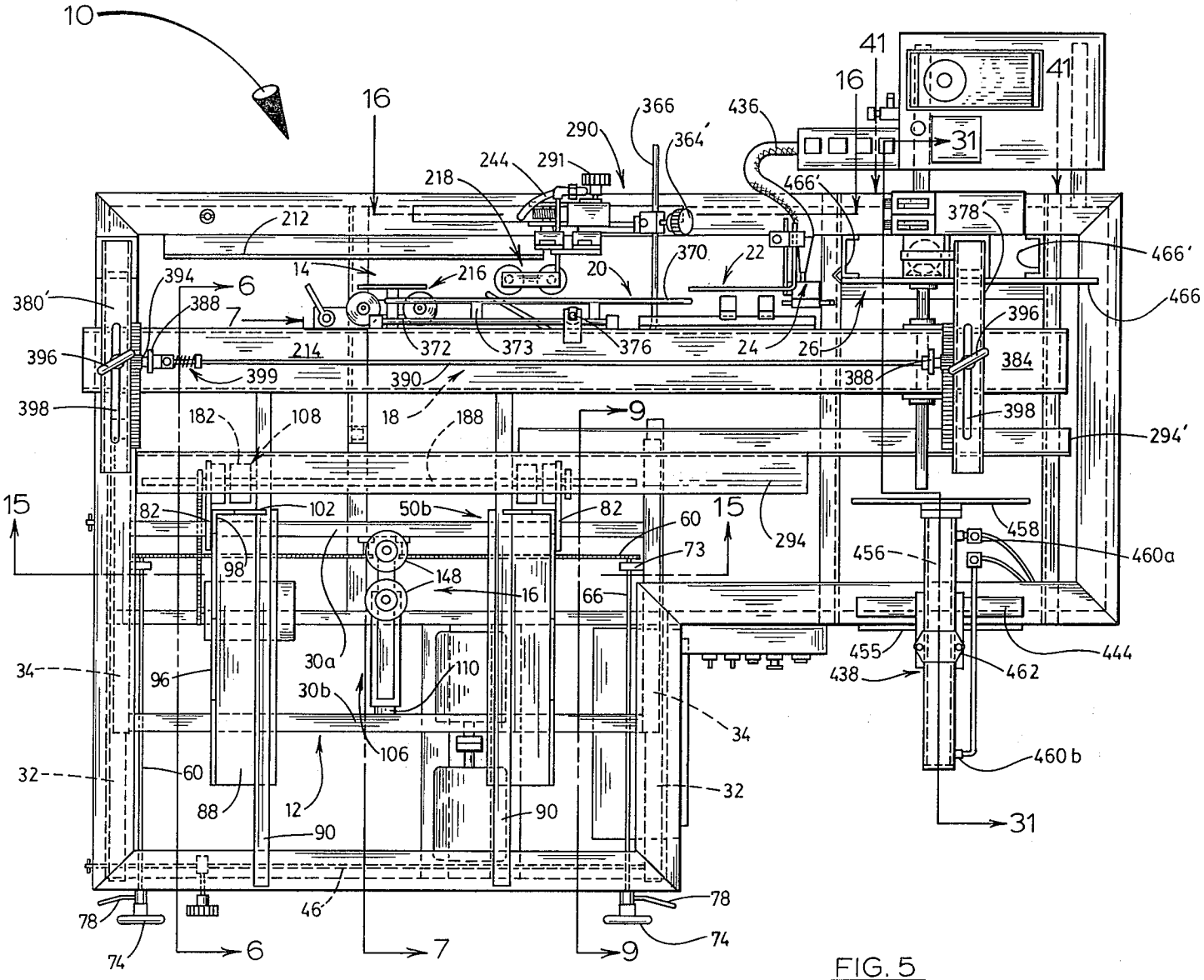
FIG. 5 is a top plan view of the machine.

Affixed to and projected above each of the mounting plates 82, there is a side plate 96. This plate extends along the upper side surface of the upright portion of the member forming plate 88, as best shown in FIGS. 5 and 6. In practice, the side plate 96 is welded or otherwise rigidly affixed to the uppermost side surface of the right angle member forming the plate 88. Additionally, a right-angle upright 98 is provided in abutted relation with the plate 96 for forming a corner upright for each of the side assemblies 28*a* and 28*b* of the hopper. Each of the corner uprights is provided with a pair of conventional adjustment brackets 100 on which is mounted a front plate 102. Hence, the brackets 100 serve to adjustably mount and support front plates 102 for positional displacement in vertical planes.

The front plates 102 terminate above the upper surface of the plate 88, FIG. 15, to define a discharge throat 104 through which knocked-down cases supported within a stack confined in the hopper 12 serially are discharged from the hopper via the case-transfer station 16. It should therefore be apparent that vertical dimensions of the discharge throat 104 readily may be varied simply by repositioning the front plates 102 utilizing adjustment brackets 100.

The purpose of the discharge throat 104 is, of course, to accommodate a discharge of knocked-down cases C from the hopper 12. In practice, the discharge of cases from the hopper 12 is achieved through utilization of a picker assembly 106 and feed roll assembly 108 disposed beneath the hopper 12. For the sake of convenience and in terms of function, the assemblies 106 and 108 are deemed collectively to define the station 16.

Figures 7, 8:
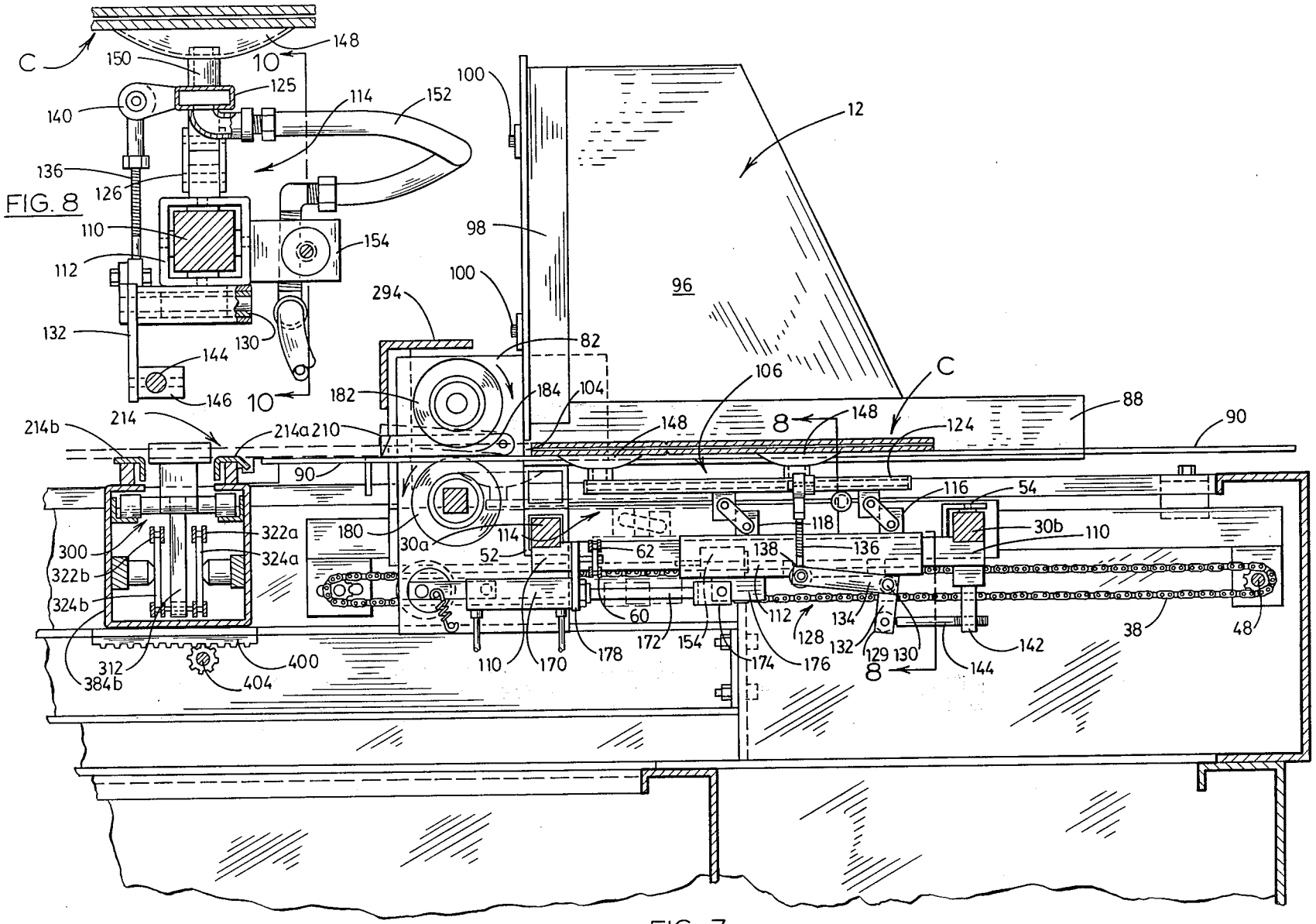
FIG. 7 is a sectional view taken generally along lines 7—7 of FIG. 5.
FIG. 8 is a sectional view taken generally along lines 8—8 of FIG. 7.
Figure 11:
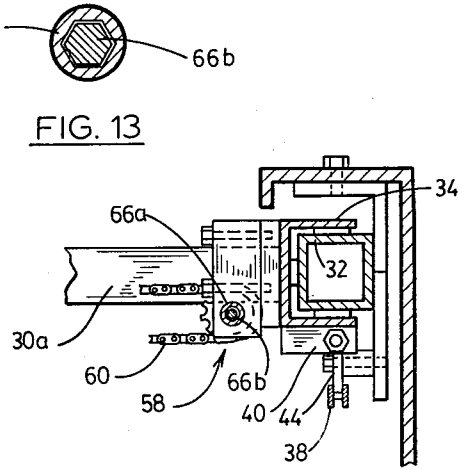
FIG. 11 is a sectional view taken generally along lines 11—11 of FIG. 9.
Figure 13:
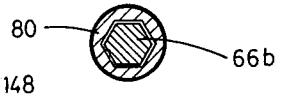
FIG. 13 is a sectional view taken generally along lines 13—13 of FIG. 9.
Figure 10:
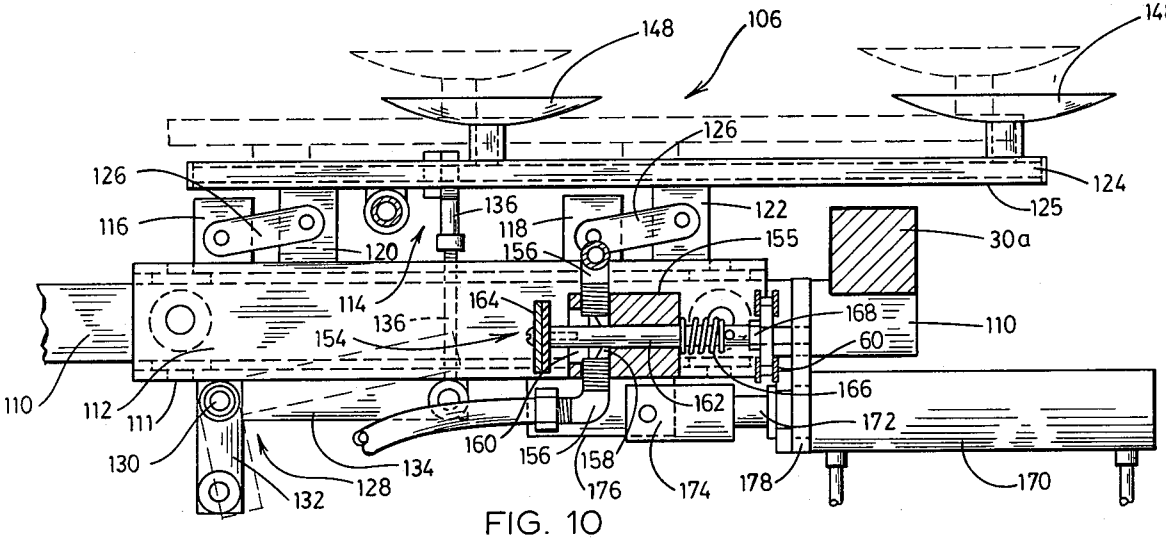
FIG. 10 is a sectional view taken generally along lines 10—10 of FIG. 8.

The picker assembly 106 is supported by a suspension beam 110, FIGS. 7, 8, and 10, extended midway between and in parallelism with the coupling beams 56, along the center line of the hopper 12. In practice, the beam 110 functions as a bearing rail and is connected at its opposite ends to the support rails 30*a* and 30*b* to be supported thereby.

A sleeve-like bearing 111 defining a truck 112 is mounted on the beam 110 and adapted to slide therealong for purposes of supporting a picker-cup actuating assembly 114. Mounted on the upper surface of the truck 112 there is a pair of axially aligned mounting blocks 116 and 118. The mounting blocks 116 and 118, in turn, are connected to axially aligned support blocks 120 and 122, projected downwardly from a manifold assembly 124 including a tubular manifold 125. The blocks 116 and 120, and the blocks 118 and 122 are, respectively, interconnected through pivotal toggle coupling links 126. These links define a parallel linkage and serve to accommodate vertical motion of the manifold assembly 124, relative to the truck 112 supported by the beam 110.

Consequently, an upward displacement of the manifold assembly 124 serves to induce pivotal motion of the toggle links 126, relative to the mounting and support blocks interconnected thereby. Hence, it can be appreciated that the picker-cup actuating assembly 114 is supported by the truck 112 for rectilinear motion in both horizontal and vertical directions, while being transported horizontally by the truck.

Vertical motion is imparted to the picker-cup actuating assembly through the use of a bell crank assembly, generally designated 128, FIG. 7. This assembly comprises a right-angle member 129 pivotally suspended from beneath the truck 112 through the use of a suitable bearing pin assembly 130, mounted on the truck 112. The member 129 of the bell crank assembly 128 includes a short vertical leg 132 and a long, horizontal leg 134. The length of the leg 134 has the practical effect of amplifying motion imparted to the leg 132. To the extended end of the leg 134 there is connected a lifter rod 136. This rod is connected to the leg 134 through a suitable journal or bearing assembly 138 while the uppermost end thereof is connected through a similar bearing assembly 140 to the manifold assembly 124. It should not be apparent that pivotal motion imparted to the bell crank assembly 128 results in vertical motion being imparted to the manifold assembly 124 and that such motion necessarily is accommodated by the toggle links 126 connected thereto.

In order to impart desired pivotal motion to the bell crank assembly 128, there is suspended from beneath the beam 110 a rigid bracket 142. From this bracket there is projected a stop 144. The stop is projected horizontally and is located within the path of an impact tab 146 rigidly mounted on the arm 132, FIG. 8. Consequently, as the picker-cup actuating assembly 114 is retracted relative to the carton-squaring station 14, the tab 146 engages the stop 144, thus pivotal motion is imparted to the bell crank assembly 128 as motion of the leg 132 in a horizontal direction is arrested. The lifting arm 138 now is moved upwardly in response to upward movement of the leg 134, for thus elevating the picker-cup actuating assembly 114. Conversely, upon being moved toward the carton-squaring station, the tab 146 disengages itself from the stop 144 for thus permitting the picker-cup actuating assembly 114 to gravitate downwardly as the bell crank assembly is pivotally displaced.

Connected in communication with the manifold 125, there is a pair of picker cups 148. These cups comprise negative pressure pneumatic cups of substantially conventional design. It is important to note that the picker cups 148 are flexible and open upwardly for engaging the lowermost surface of the bottom-most knocked-down case, supported within the hopper 12. In practice, each of the cups 148 communicates with the manifold 125 via a stub conduit 150. Thus a vacuum may be drawn down in the manifold and applied to the vacuum cups 148, simultaneously.

As shown in FIG. 8, a flexible vacuum conduit 152 serves to interconnect the manifold 125 with a vacuum control valve 154 mounted on the truck 112. The valve 154 is of simplistic design and includes a block 155 having mounted therein a pair of coaxially aligned, mutually spaced fittings 156, FIG. 10, communicating with a plenum chamber 158. The chamber 158, in turn, is provided with a port 160 communicating with ambient atmosphere and adapted to be closed by a spring-loaded piston 162. The piston 162 includes a shaft extended through the port 160, and a head 164 of a circular configuration mounted on the shaft. The head is adapted to seat in sealing relation with the port 160. The shaft is a spring-loaded shaft and includes a helical spring 166 mounted thereon normally to urge the head 164 into seated relation with the port 160. Thus the port is sealed so that a vacuum may be established in the chamber 158 and transmitted therethrough.

In order to interrupt the vacuum established within the chamber 158, and therefore within the manifold 125, a stop 168 is positioned in coaxial alignment with the shaft of the piston 162, in a position to arrest the motion of the shaft as the valve is transported by the truck 112 toward the case-squaring station 14. Thus the spring 166 is caused to collapse and the piston head 164 to be displaced from its seated relation with respect to the port 160, whereby the chamber 158 is rapidly vented to atmosphere for releasing the vacuum in the manifold. Thus the cups 148 are pneumatically de-energized.

Of course, reverse motion of the picker-cup actuating assembly results in a disengagement of the piston shaft with the stop 168 for thereby permitting the spring 166 to again re-seat the piston head 164 relative to the opening 160 in order to again seal the chamber 158. Thus a vacuum again is communicated to the vacuum cups 148.

Rectilinear displacement of the picker-cup actuating assembly 114 is effected through the use of an air cylinder 170 having a shaft 172 connected through a clevis 174 to a bracket 176, depending from the bearing forming the truck 112. Consequently, by reversely pressurizing the air cylinder 170, the shaft 172 thereof is reciprocated, whereupon, reciprocation is imparted to the truck 112 for thus imparting reciprocation to the picker assembly 106.

As a practical matter, the air cylinder 170 is supported by a suitable bracket 178 rigidly affixed to the beam 110. The bracket 178 also functions as a mounting for the aforementioned stop 168, as well as the bearing blocks 62, aforementioned, FIG. 15.

The feed roll assembly 108 includes a bottom nip roller 180 and a top nip roller 182 arranged in vertical coplanar alignment and define therebetween a bite 184. The purpose of the bite is to receive from the picker assembly 106, knocked-down cases to be transferred to the carton-squaring station 14. Preferably, the roller 180 is a segmented roller having first and second coaxially aligned cylindrical segments aligned with the plate 88 of the hopper 12, and similarly, the roller 182, FIG. 5, is a segmented roller having segments arranged in vertical alignment with the segments of the roller 180. Thus, the rollers 180 and 182 are generally of a cylindrical configuration having an interrupted center portion, while the end portions thereof are in substantial alignment with the plate 88. Furthermore, the bite 184 is axially aligned with the discharge throat 104 of the hopper 12 and the strips 90, whereby the knocked-down cases are readily received in the bite.

The roller 180 is affixed to a drive shaft 186 while the roller 182 is affixed to a drive shaft 188, FIG. 6. Thus, the rollers 180 and 182 are supported to be driven in response to rotation imparted to the drive shafts 186 and 188, respectively.

In order to impart opposed rotation to the shafts 186 and 188, there is affixed to the shafts, sprocket wheels 190 and 192, respectively. Trained about the sprocket wheels 190 and 192, in reverse directions, there is a drive chain 194, which chain also is trained about a drive sprocket 196. An idler or tensioning sprocket 198 is provided for adjusting tension in the chain 194. It should now be apparent that as the drive sprocket 196 is driven in rotation, rotary motion is imparted to the shaft 186 and 188 for thus imparting rotation to the rollers 180 and 182, respectively. At this juncture, it is noted that a motor 200 having an output shaft keyed or pinned to an output sprocket 202 is provided for driving the drive chain 194, via a drive chain 204 trained about the sprocket 202, and a speed reduction sprocket 206 connected with a drive sprocket 196, preferably through a common drive shaft 208 in a conventional manner.

It is now to be understood that upon being energized, the air cylinder 170 drives the truck 112 along the beam 110 to retract the picker assembly 106 to an initial position located beneath a stack of knocked-down cases defined within the hopper 12. As the truck approaches the limit of its travel, in a retracting direction, the bell crank assembly 128 is pivoted, in response to engagement of the tab 146 with the stop 144, for thus causing the lifting arm 136 to elevate the picker-cup actuating assembly 114. As this assembly is lifted, the cups 148 are brought into engaged relation to the bottom-most knocked-down case of the stack. Vacuum now is applied to the cups 148 whereupon the cups are attached to the bottom-most case of the stack with which they are engaged. Substantially simultaneously, the air cylinder 170 is activated for retracting the shaft 172 in a direction for causing the truck 112 to advance in a case-feeding direction, toward the case-squaring station 14, whereupon the arm 132 of the bell crank assembly disengages a stop 144. This normally would permit the picker-cup actuating assembly 114 to drop or gravitate; however, due to the fact that these cups are attached to a case supported by the support strips 90, the picker cup actuating assembly remains elevated as the bottom-most case C is advanced toward the bite 184 of the feed roller assembly 108.

As the truck 112 approaches the limit of its throw in a case-feeding direction, the extended end of the shaft 163 of the piston 162 for the valve 154, engages the stop 168 for thus causing this shaft to advance against the spring 166 in a collapsing direction, whereupon the piston head 164 is lifted and thus unseated with respect to the port 160. Venting of the chamber 158 to atmosphere is thereby achieved for thus "killing" the vacuum applied to the cups 148 via the conduit 152 and the manifold 125, whereupon the cups 148 are released from the case being advanced.

As the vacuum is thus killed, or vented, the air cylinder 170 is again actuated for driving the truck 112 toward its initial or retracted position, whereupon the cups 148 drop and a cycle of operation of the picker assembly 106 is completed.

Figure 14:
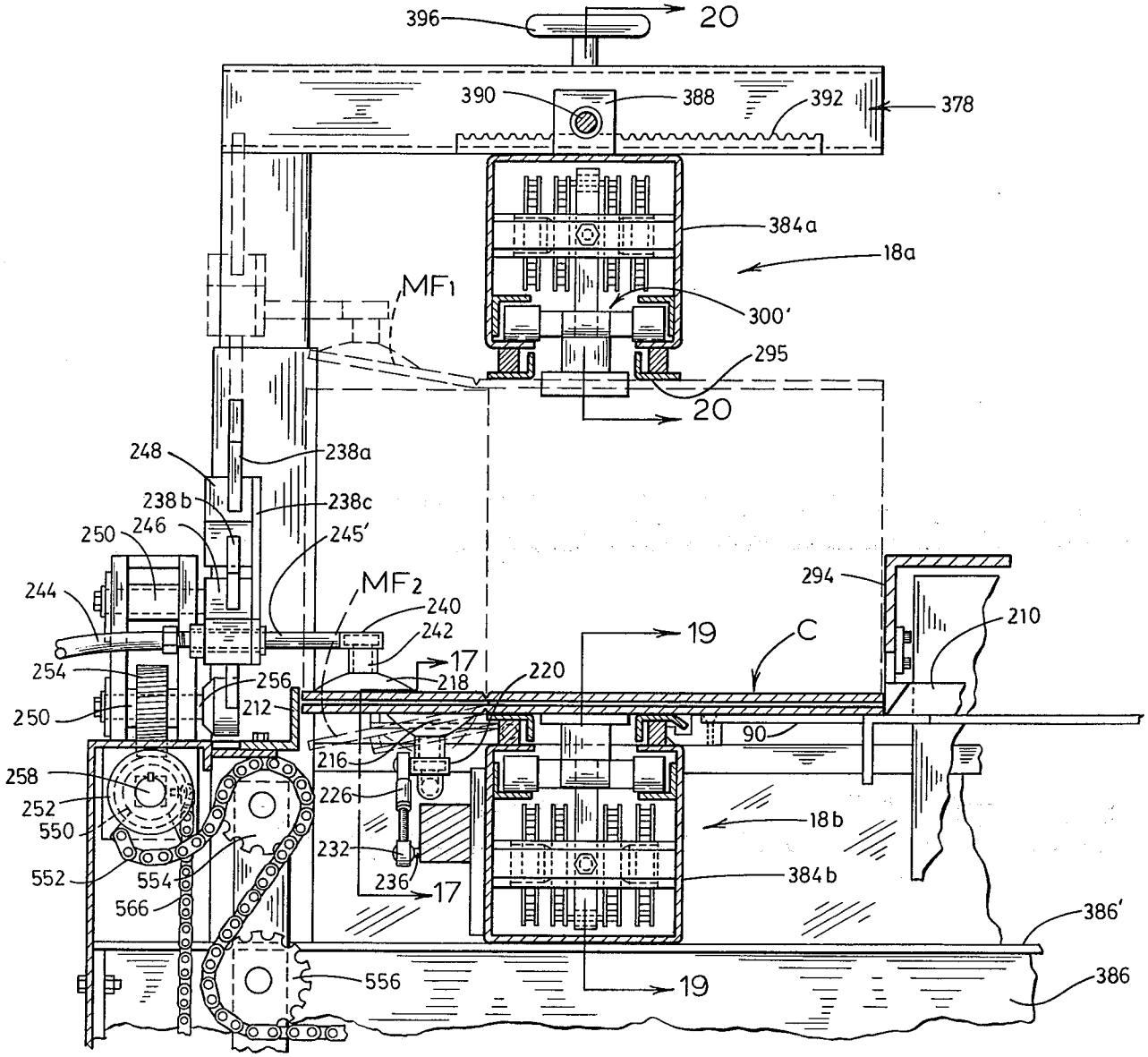
FIG. 14 is a fragmented, partially sectioned view depicting a knocked-down case prior to expansion at a case-squaring station provided for the machine, an erected case being shown in phantom.

It is important to note that once the truck 112 reaches its limit of travel in a feeding direction, a peripheral portion of the knocked-down case C is extended through the discharge throat 104 of the hopper 12 and into the bite 184 between the rollers 180 and 182. Since the rollers 180 and 182 comprise live rollers driven by the motor 200, these rollers "grab" and "kick" the case C toward the case-squaring station 14. In order to prevent bounce-back of the case thus picked, a blocking dog 210, FIGS. 6, 7, and 14, is pivotally supported downstream of the bite 184 of the rollers and is adapted to be lifted by a case as a case C is fed or "kicked" by the rollers and to be dropped behind the case as it thus is fed for preventing the case from bouncing back toward the bite, once its motion in a feeding direction is arrested at the case-squaring station.

Of course, in the event adjustment of the position of the hopper 12 becomes necessary, in the event changes in the size of the knocked-down cases necessitates that such changes be effected, the nipple assembly 80 is loosened, if required, for accommodating a telescoping action of the segments of the shafts **66*a* and 66*b*, and torque is applied to the shaft 48 for causing the chain 38 to advance or retract the hopper 12, as desired. Similarly, in the event it becomes necessary to reposition the side plates 96, relative to each other, the locks 78 are released and the hand wheels 76 rotated for applying torque to the sprockets 64 attached thereto for causing the chains 60 to reposition the side plate support assemblies 50*a* and 50*b***, attached thereto.

In view of the foregoing, it is believed to be readily apparent that the case-transfer section is particularly adapted for rapidly feeding knocked-down cases to the case-squaring station 14.

(Case-Squaring Station)

As hereinbefore mentioned, knocked-down cases C are squared or expanded at the case-squaring station 14 subsequent to their being received from the case-transfer station 16. Consequently, the station 14 is positioned in the path of the knocked-down cases as they are fed from the case-transfer station 16. This station is provided with an elongated stop 212, FIG. 14, rigidly mounted on the frame of the machine in a suitable manner. The purpose of the stop 212 is to arrest motion of the cases imparted thereto by the feed roll assembly 108. It is noted that the support strips 90 extend from the hopper to a position immediately adjacent to the case-squaring station and terminate in juxtaposition with a track 214 which defines a case-advancing path from the station 14 through the machine 10. This track is perpendicularly related to the path along which the cases C are fed from the hopper 12 to the station 14. Hence, as the knocked-down cases leave the case-transfer station, they strike the stop 212 so that motion thereof is arrested by the longitudinal stop. Bounce-back of knocked cases striking the stop 212, as aforementioned, is prevented by the dog 210. Thus the cases serially are transferred to the station in a flap-first orientation, FIG. 48B, and come to rest on the track 214 between the stop 212 and the dog 210.

Figure 16:
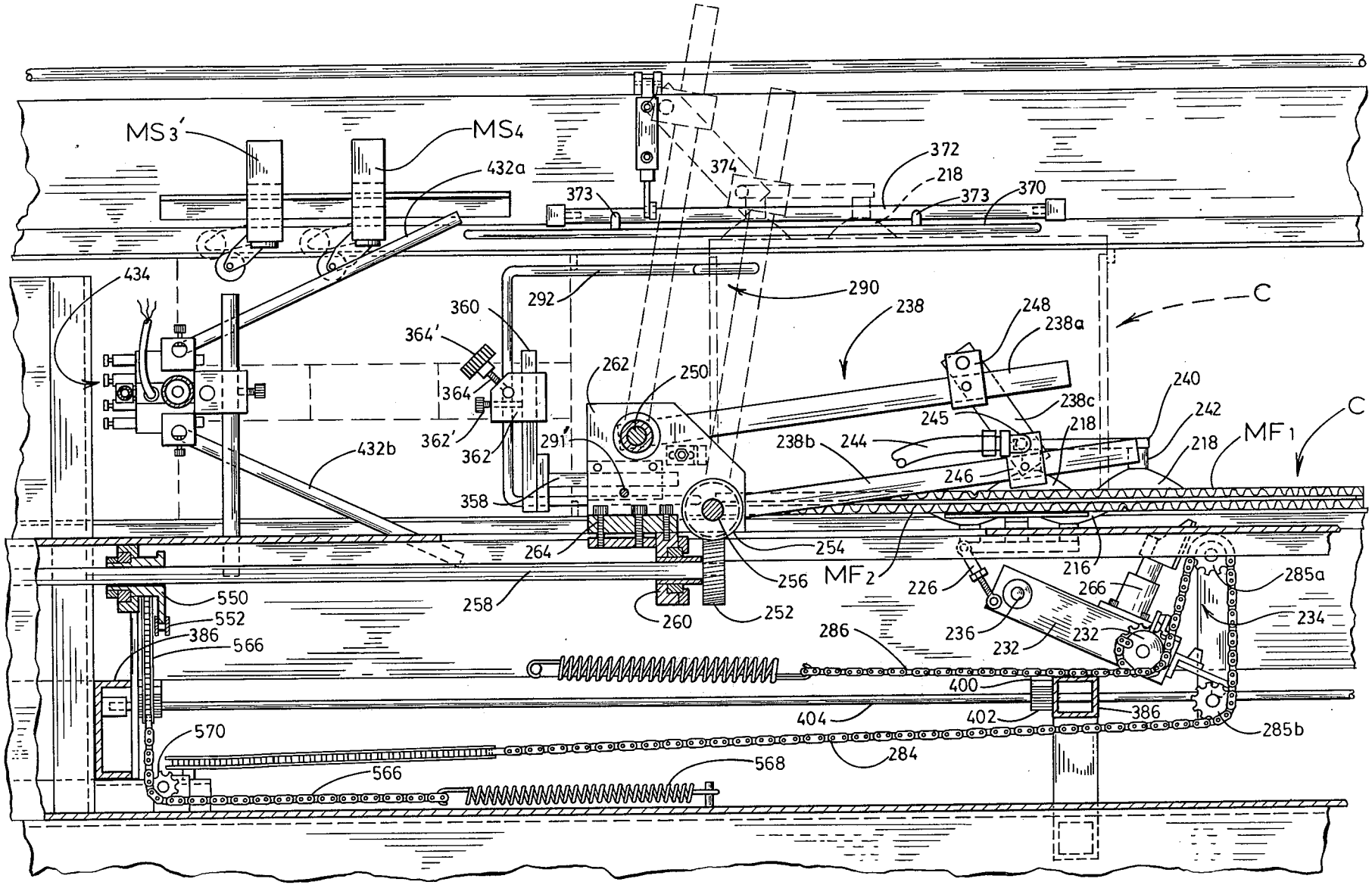
FIG. 16 is the vertically sectioned view of a case-squaring station provided for the machine, taken generally along lines 16—16 of FIG. 5, but on an enlarged scale.

In order to initiate a case-squaring operation for a knocked-down case supported at the case-squaring station 14, there is provided a lower pair of vacuum cups 216 and an upper pair of vacuum cups 218, FIG. 16. Since the vacuum cups 216 and 218 comprise negative pressure pneumatic cups of conventional design, a detailed description of the cups 216 and 218 is omitted in the interest of brevity.

Figure 17:
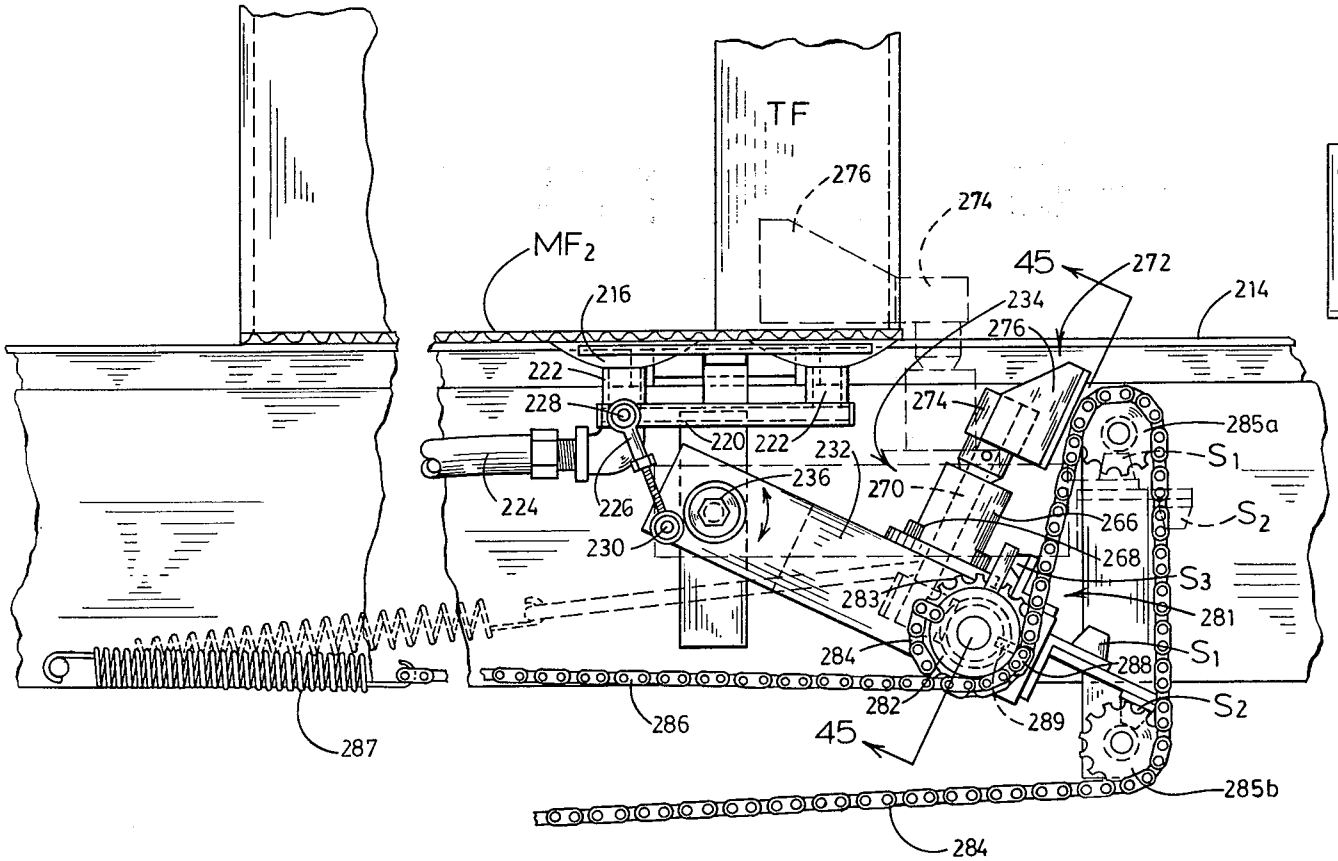
FIG. 17 is a vertically sectioned view taken generally along lines 17—17 of FIG. 14, but on an enlarged scale.
Figure 18:
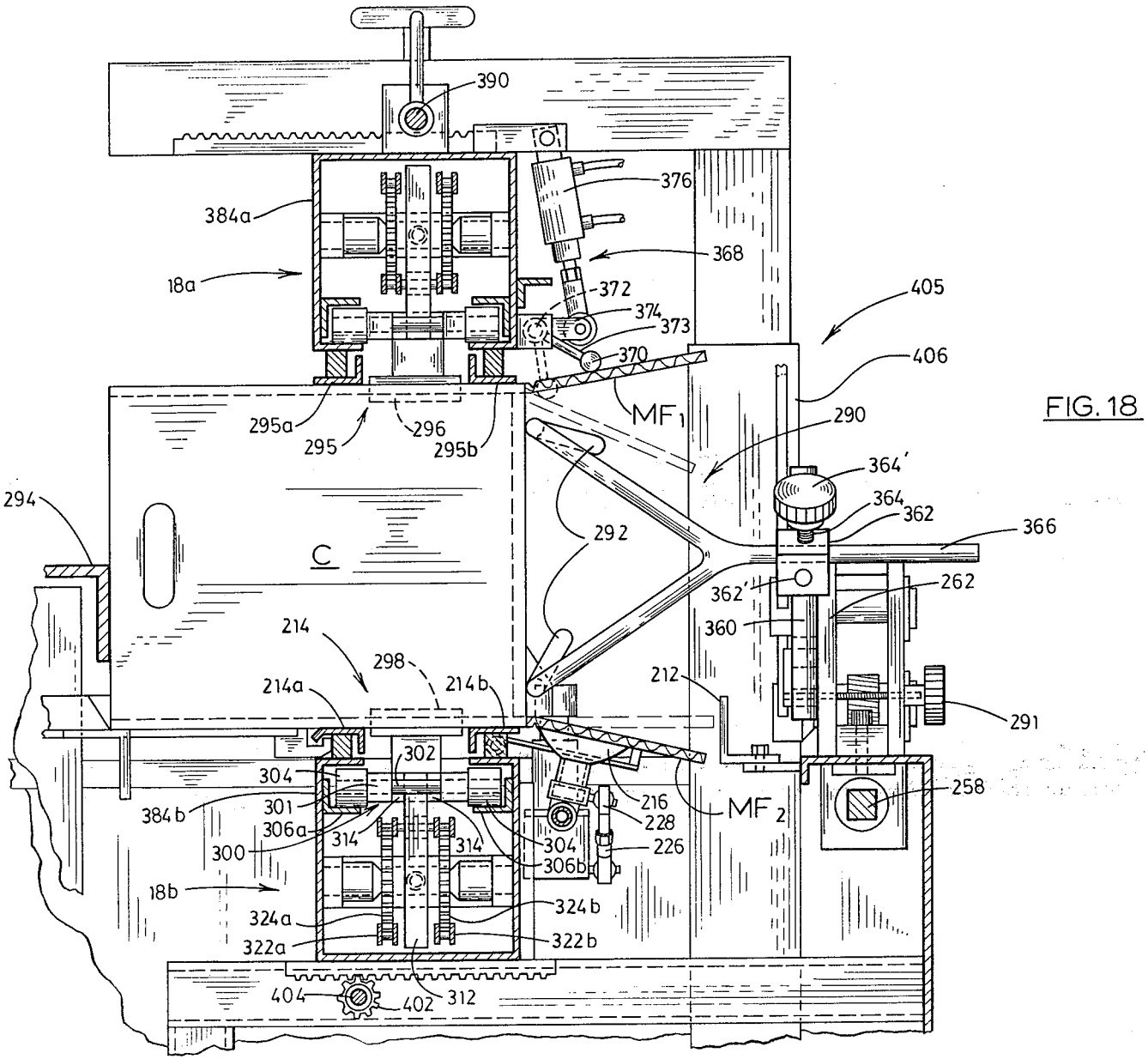
FIG. 18 is a vertically sectioned view taken generally along lines 18—18 of FIG. 2.

Referring first to the lower vacuum cups 216, it is noted that these cups are supported by a manifold 220, FIGS. 14 and 17. In practice, the lower cups 216 are mounted at the upper ends of stub conduits 222 through which vacuum communication is established between the cups and the manifold 220. The manifold 220, in turn, is connected with a vacuum conduit 224 through which a vacuum is drawn for purposes of pneumatically energizing the cups 216. It is believed important to note that the cups 216 are elevated through the use of a lifting rod 226, pivotally connected at one end thereof to the manifold 220, utilizing a journal bearing 228. As shown in FIG. 18, the journal bearing 228 accommodates a rocking motion of the modified 220 about its axis in order to accommodate a downward breaking of the flaps $MF_2$, as illustrated. The opposite end of the rod 226 is connected through a journal bearing 230 to a pivotal mounting or actuating arm 232. This arm also supports a trailing flap striker assembly, generally designated 234, hereinafter more fully described.

At this juncture, it is sufficient to appreciate that the mounting arm 232 is periodically oscillated about a journal bearing 236 and, further, that the lifting rod 226 is caused to reciprocate in a substantially vertical plane, in order to lift and lower the lower vacuum cups 216.

As best shown in FIG. 17, the cups 216, when elevated, engage the lowermost surface of the lower major flap $MF_2$ and are fully elevated only when the mounting arm 232 is at the lower limit of its throw about the axis of the journal bearing 236. Consequently, it should also be apparent that as the mounting arm 232 is pivotally advanced in an upward direction, the lower vacuum cups 216 are lowered, drawing with them the flap $MF_2$. Thus, the lowering of the vacuum cups 216 results in the lower flap $MF_2$ being broken downwardly, as best illustrated in FIG. 14. Hence, the lower vacuum cups 216 not only function to secure the case C in fixed relation with the case-squaring station 14, but also serve to downwardly break the flaps $MF_2$, as case-squaring operations are performed.

Turning for a moment to FIG. 16, it can be seen that the pair of upper vacuum cups 218 are supported for arcuate displacement in a vertical plane by a parallel linkage, generally designated 238, which includes links 238*a*, 238*b*, and 238*c*.

Each of the upper vacuum cups 218 is connected with a vacuum manifold 240 via a stub conduit 242, mounted on the manifold, through which vacuum is communicated to the cups 218 from the manifold. A vacuum is drawn down in the manifold 240 via a flexible conduit 244, connected in communication to the conduit 240, via a coupling 245. This coupling includes a rigid tube 245', FIG. 14, extending through a block 246 mounted on the link 238*b*, and secured in place by a suitable setscrew, not designated. It is sufficient to appreciate that in operation, the block 246 remains stationary relative to the link 238*b*, and serves as a journal block for the rigid tube 245' of the coupling 245. The coupling 245 is extended to and connected in supporting and communicating relation with the manifold 240.

Also connected in fixed relation with the manifold 240 is the link 238*c*, aforementioned. The link 238*c* is connected in any suitable manner with the manifold 240 preferably through the rigid tube 245', which assures that a fixed angular relationship is maintained between the longitudinal axes of the manifold 240 and the link 238*c*. Since the details of the manner in which the manifold 240 is connected with the link 238*c* form no part of the claimed invention, a detailed discussion thereof is omitted in the interest of brevity. However, it is to be understood that, in practice, the link 238*c* is connected through a set screw to the tube 245' and also is journaled, by suitable means, at its opposite end, to a block 248, adjustably mounted on the link 238*c* in a manner such that the manifold 240, and consequently the cups 218, are maintained in a horizontal plane throughout the arcuate displacement of the parallel linkage 238.

The links 238*a* and 238*b* are supported by suitable journal bearings 250 located at the pivotal or base ends thereof and serve to support these links for pivotal motion about parallel axes. Referring for a moment to FIGS. 14 and 16, collectively, it can be seen that the parallel linkage is driven in rotation through helical gearing including a driving gear 252 and a driven gear 254. The gear 254 is rigidly mounted on a drive shaft 256, which is rigidly coupled with the link 238*b*, while the driving gear 252 is rigidly mounted on a drive shaft 258, supported by a bearing block 260. Consequently, as the drive shaft 258 is driven to impart rotation to the helical gear 252, responsive rotation is imparted to the gear 254 for applying torque to the drive shaft 256. Torque thus applied to the drive shaft 256 causes the shaft to rotate for pivotally displacing the link 238*b*. Thus, the linkage 238 is elevated, or lowered, in response to selected rotational displacement of the shaft 258.

As a practical matter, the parallel linkage is supported at its base by a mounting block 262, adapted to be adjustably positioned for apparent purposes of adapting the machine for operation on cases of varying sizes. As shown the mounting block 262 is secured in adjusted positions by means of positional adjusting screws 264.

It is believed to be apparent that once the cups 216 and 218 engage with the surfaces of the flaps $MF_1$ and $MF_2$, downward motion of the cups 216 and the upward motion of the cups 218 result in the panel $MP_1$ being displaced along an arcuate path to assume a squared or open-end tubular configuration, illustrated in phantom in FIGS. 14, 15 and 16. It is important to note that the distance between the cups 216 and 218, once the cups are oppositely displaced to the limit of their throw, is a distance greater than the vertical dimension of the case C. Consequently, an upward breaking of the major flap $MF_1$, as well as a downward breaking of the major flap $MF_2$, is achieved. Of course, once the case thus has been squared, or expanded to a tubular, open-end configuration in response to a separation of the cups 216 and 218 under a vacuum-energized condition, the cups are pneumatically de-energized for releasing the flaps, thereby permitting the case to be advanced from the case-squaring station 14.

(Striker Assembly)

Concurrently, with the elevational displacement of the upper vacuum cups 218 and the lower vacuum cups 216, elevation of the striker assembly 234 is achieved for purposes of positioning the striker for in-folding the trailing flap TF, as it assumes a vertical position.

The striker assembly 234 includes a bearing mount 266 affixed to the mounting arm 232, near the distal end thereof, by screws 268. Extended concentrically through the bearing mount 266, and supported thereby, is a drive shaft 270 having mounted at its upper end a striker arm assembly, generally designated 272. The striker arm assembly 272 includes a head 274, mounted on and affixed to the drive shaft 270, having perpendicularly projected therefrom a striker arm 276. The purpose of the arm 276 is to rotate into flap-displacing engagement with the trailing flap TF, once the striker assembly 234 is elevated above the plane of the track 214.

Figure 45:
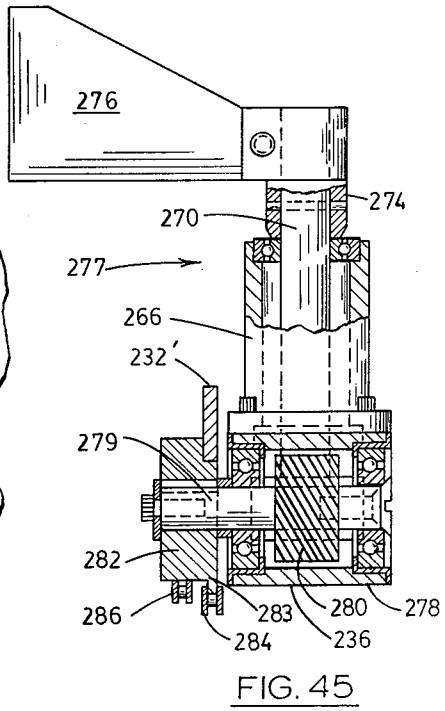
FIG. 45 is a cross-sectional view taken generally along lines 45—45 of FIG. 17.

An inward folding of the flap TF, by the arm 234, is achieved in response to pivotal displacement of the arm 276. Inward folding of the flap TF is facilitated by the upward breaking of the flap $MF_1$ and the downward breaking of the flap $MF_2$, in response to the displacement of the vacuum cups 216 and 218, aforedescribed, while pivotal displacement of the arm 276 is effected by an arm drive mechanism, generally designated 277, FIG. 45. Referring for a moment to FIG. 45, the arm drive mechanism 277 includes a bearing housing 278, formed by a bore extended transversely through the mounting arm 232, having extended therethrough a drive shaft 279. The drive shaft 279, in turn, is connected through a helical gearing 280, of conventional design, to the drive shaft 270. It should now be apparent that rotational displacement of the shaft 279 is transmitted to the shaft 270 via the helical gearing 280.

In order to elevate and arcuate the striker assembly 234, in a flap-folding mode, there is provided a chain-actuating mechanism, generally designated 281, FIG. 17. This mechanism includes a hub 282, rigidly affixed to the shaft 279 and having mounted thereon and affixed thereto a sprocket wheel 283. To the sprocket wheel 283 there is affixed a first chain 284. As shown in FIG. 17, the chain 284 is pinned at its end to the sprocket wheel 283, and trained thereabout. The chain 284 travels over an upper assembly positioning idler sprocket **285*a* and downwardly about a direction reversing idler sprocket 285*b*. It should be apparent that a tensioning of the chain 284 will serve to impart rotation in a counterclockwise direction, as viewed in FIG. 17, to the sprocket wheel 283, provided the sprocket is free to rotate. Such rotation is transmitted via the shaft 279 and gearing 280 to the shaft 270, and consequently the arm 276. However, in the event the sprocket wheel is secured against rotation, tensioning of the chain 284 serves to lift or elevate the assembly 234 toward the idler sprocket 285*a* as the chain 284 is caused to perform a lifting function. Consequently, in order to elevate the assembly 234 and then accommodate rotation of the arm 276, it is necessary that the sprocket wheel 283 initially be supported in a stationary relationship with the arm 232, until such time as the arm is pivotally displaced upwardly to the limit of its throw, and thereafter, the sprocket wheel 283 be released for rotation to permit the arm 276** to pivot in flap-folding displacement.

In order to accommodate the desired elevating and pivoting operation of the assembly 234, there is provided a second chain 286, spring-loaded by a tension spring 287. The spring 287 is fixed at one end to a frame member, not designated, and at its opposite end to the chain 286. The chain 286, in turn, is pinned to the sprocket wheel, via the hub 282, at its terminal link 288 by a suitable pin 289. Hence, as the chain 284 initially is tensioned, the hub 282, and consequently the sprocket 283, is supported against rotation by the force of the spring 287 applied to the hub, through the chain 286. Thus, a tensioning of the chain 284 results in the assembly 234 being elevated to position the striker arm 276 above the plane of the track 214. Consequently, once the assembly 234 is elevated to the limit of the throw of the arm 232, as determined by stop $S_1$ affixed to the arm, continued tensioning of the chain 284 results in the spring 287 being elongated. The stop $S_1$ is positioned from the sprocket **285*a*, once the arm 232 is elevated to the upper limit of its throw, as indicated in phantom, FIG. 17. Elongation of the spring 287 permits the sprocket 283 to undergo rotation in a counterclockwise direction, for thus driving the arm 276 in a flap-closing direction. As the arm 276 is rotated, the flap TF is engaged and forced to fold inwardly. The angular displacement of the arm 276 is approximately 90° while the angular displacement of the sprocket necessary to drive the arm 276 through 90° of displacement is approximately 180°. It is noted that the arm 276** engages the flap TF near its lower end, at a position such that there exists a lesser likelihood that the flap will deform than will exist if the arm strikes the flap TF near its midportion and displacement of the flap is resisted near either of its opposite ends.

Once the chain 284 is relaxed, subsequent to the arm 276 being displaced to the limit of its throw in a flap-folding direction, the spring 287 overcomes the applied forces of the chain 284 and positively retracts the arm 276 of the assembly 234 and permits the arm 232 to gravitate to its lowermost position, determined by an additional stop, designated $S_2$, striking a suitable collar or abutment, not shown, disposed adjacent to the sprocket **285*b***.

Additionally, a stop $S_3$, mounted on the arm 232 and pin 232' projected from the hub 282, is provided for limiting the clockwise throw of the sprocket 283 and, consequently, the angular position assumed by the arm 276, at the limit of its throw, in a direction opposite to the direction in which the arm is displaced in its flap-folding operation.

It is also to be understood that as the case is squared, or vertically expanded, the leading flap LF is engaged by a leading flap-folding plow assembly 290, FIG. 48B. As a practical matter, the assembly 290 includes a pair of forwardly projected, angularly configured horns 292, FIG. 2, the purpose of which is to engage the leading flap LF, as the case is expanded in response to the separating displacement of the cups 216 and 218.

Hence, it can be appreciated that each knocked-down case is fed to the case-squaring station 14, its motion arrested by the longitudinal stop 212, and the blocking dog 210, the cups 216 and 218 engage the flaps $MF_1$ and $MF_2$, preparatory to expanding the case, and then are displaced in opposite directions in a common vertical plane through a distance greater than the vertical dimension of the case C, so that as the case approaches a squared or expanded configuration, the flaps $MF_1$ and $MF_2$ are broken in the directions in which the cups 216 and 218 are displaced. Thus, a simultaneous squaring of the case and a breaking of the major flaps are achieved.

As the squaring of the case occurs, the striker arm assembly 234 elevates to a position above the conveyor track 214, whereupon the striker arm 276 is pivoted for striking the trailing flap TF for thus causing the flap TF to assume an inwardly folded position. This folding of the flap TF is facilitated by the upward and downward breaking of the flaps $MF_1$ and $MF_2$, respectively. Concurrently, with the squaring of the case C, the horns 292 of the leading flap-folding assembly plow 290 strike the leading flap LF for deflecting this flap inwardly, preparatory to a pneumatic de-energization of the cups 216 and 218. As the cups 216 and 218 are de-energized, flaps $MF_1$ and $MF_2$ are released and the case C is picked up by the conveyor 18 to be advanced for further flap-manipulating operations at the minor flap-folding station 20.

(Conveyor)

Figure 27:
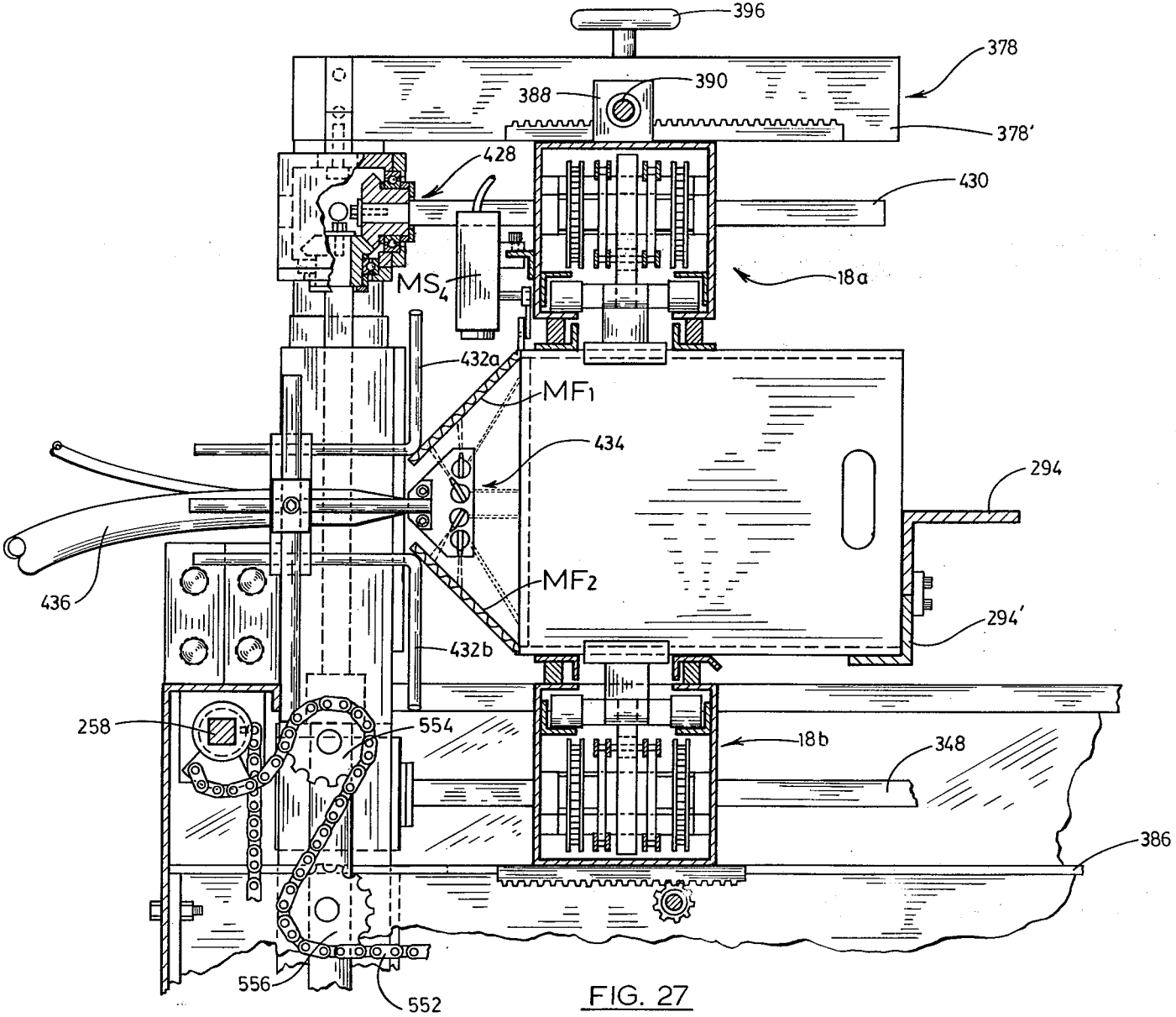
FIG. 27 is a sectional view taken generally along lines 27—27 of FIG. 2, but depicting an erected case at the glue applicator station provided for the machine.
Figure 29:
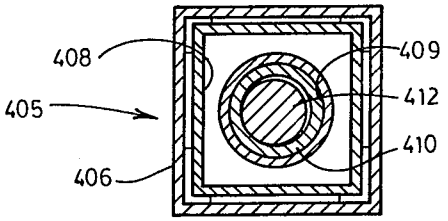
FIG. 29 is a sectional view taken generally along lines 29—29 of FIG. 28.

Referring for a moment to FIG. 5, it can be seen that the track 214 is extended horizontally through the machine 10 through the stations identified by reference numerals 14, 20, 22, 24 and to the station 26. As illustrated in FIG. 14, the conveyor 18 is made up of an upper portion, generally designated 18*a*, and a lower portion, generally designated 18*b*. Similarly, as is best shown in FIG. 18, a guide rail 294' having a lip 294', see FIGS. 5 and 27, is provided for supporting the cases C, at their ends, as they are advanced. This rail is extended through the stations in parallelism with the axis of the longitudinal stop 212 for purposes of engaging and supporting the cases C at the ends thereof opposite their flaps.

Additionally, it is to be noted that the conveyor portion 18*a* includes an upper track 295, FIG. 18, positioned in a common vertical plane with the track 214. The track 295 includes track components 295*a* and 295*b*, while the track 214, as also shown in FIG. 18, includes parallel track components 214*a* and 214*b*. The track components 295*a*, 295*b*, 214*a* and 214*b* are of similar design, excepting that the track component 214*a* is provided with a down-turned lip, not designated, which serves to assist in a transfer of knocked-down cases to the case-squaring station 14. Hence, a detailed description of each of the components is omitted. However, and as a practical matter, the track components 295*a* and 295*b* are separated a distance sufficient for accepting therebetween a normally downwardly depending cleat 296, while the track components 214*a* and 214*b* are separated a distance sufficient for accepting therebetween a normally, upwardly projected cleat 298.

The cleats 296 and 298 are arranged in vertical registry and together reciprocate from an initial position at the station 14. The cleats "pick-up" cases C at the case-squaring station 14, advance the cases continuously through the various flap-manipulating stations of the machine 10, along a path defined by the track 214, serving in conjunction with the track 295, and then return along the same path to their initial position at the case-squaring station.

It is here important to appreciate that the conveyor portions 18*a* and 18*b* are of similar design and function substantially in a common manner to achieve substantially the same result. Accordingly, a detailed description of the conveyor portion 18*a*, as well as the portion 18*b*, is not deemed necessary to provide for a complete understanding of the instant invention. Therefore, it is to be understood that the hereinafter provided description of the lowermost conveyor portion 18*b* is to be applied to the upper portion 18*a* as well, except as where otherwise indicated.

Turning now to FIG. 18, it can be seen that the cleat 298 is mounted on a truck, generally designated 300. The truck includes a frame comprising a pair of side rails 301, extended in mutual parallelism at opposite sides of the center line of the truck 300, and a pair of fore and aft axles, designated 302, FIG. 19. These axles extend transversely with respect to the rails and function as mounting axles for rollers 304. The rollers are, in turn, received in a track, generally designated 306. The track 306 includes a pair of track elements 306*a* and 306*b*, FIG. 18, extended in mutual parallelism along the length of the path of the conveyor portion 18*b*. Thus, the track 300 comprises a four-wheel truck supported by the track 306 for reciprocating displacement.

Figure 19:
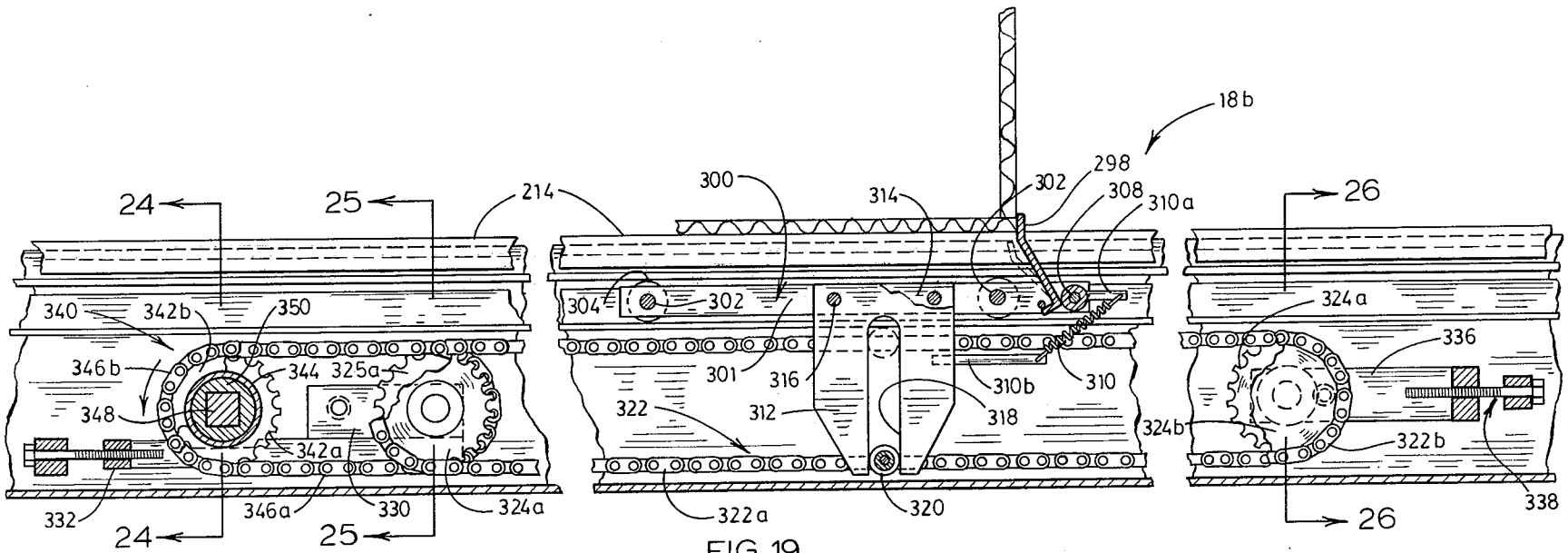
FIG. 19 is a fragmented view, taken generally along lines 19—19 of FIG. 14, depicting a lower portion of the case-conveyor provided for the machine, but depicting the case in an erected configuration and in an engaged relationship with a conveyor cleat.

With reference to FIG. 19, it can be seen that the cleat 298 comprises a cleat pivotally supported by a bearing pin 308. The cleat is spring-biased to an upright, or case-pushing configuration, by a tensioning spring 310 connected thereto at a bracket 310*a* and attached at a fixed base 310*b*, mounted on the truck 300. Consequently, the cleat 298 normally is spring-biased to an upright position, in a clockwise direction, as seen in FIG. 19, while motion of the cleat, in a counterclockwise direction, is accommodated by the spring 310.

Suspended from between the pair of rails 301, is a lost-motion plate 312, best seen in FIG. 19. In order to mount the plate 312 between the rails 301, spacer blocks 314, FIG. 18, are provided at each of the opposite sides of the plate 312 for thus supporting in a sandwiching manner, the plate 312. Suitable screws 316, FIG. 19, are provided for securing the plate 312 and spacer blocks 314 to the rails 301 of the truck.

Figure 26:
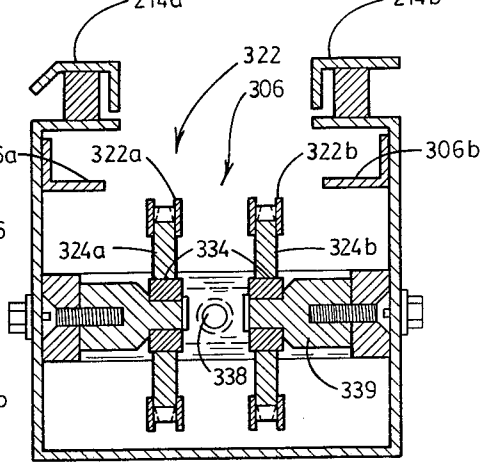
FIG. 26 is a sectional view taken generally along lines 26—26 of FIG. 19.

Additionally, it is noted that the plate 312 includes an elongated, lost-motion slot 318 adapted to receive therein a plate-pushing roller 320, mounted for plate-driving displacement on a chain assembly, designated 322. While the chain assembly 322 is here considered to comprise a single chain, it does in fact, as best illustrated in FIG. 26, include a first endless chain member 322*a* and a second chain member 322*b*. These members are disposed in co-terminous relation in mutually parallel planes and collectively define the chain assembly 322.

Figure 25:
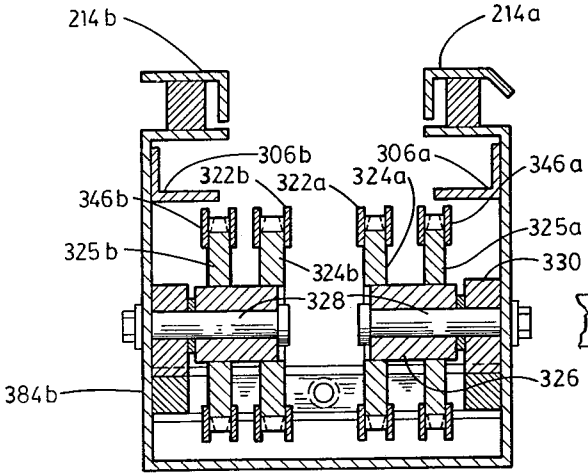
FIG. 25 is a sectional view taken generally along lines 25—25 of FIG. 19.

The chain member 322*a* is trained about a first pair of horizontally spaced sprockets, designated 324*a*, while the chain member 322*b* is trained about a second pair of horizontally spaced sprockets, designated 324*b*. It is to be understood that a sprocket of each pair of sprockets 324*a* and 324*b* is driven by one of a pair of chain assembly driver sprockets 325*a* and 325*b*. For the sake of convenience, the driven sprocket of each of the pairs 324*a* and 324*b* is referred to simply as a driven sprocket for the pair, without further designation. The driven sprocket 324*a*, as shown in FIG. 25, is coupled with the chain assembly driver sprockets, designated 325*a*, through a common bushing 326, mounted for free-running rotation on a fixed shaft 328. The driven sprocket 324*a* and the driver sprocket 325*a* are each rigidly affixed to the bushing 326, as by welding or the like, in order that driven rotation may be imparted to the sprocket 324*a* via the sprocket 325*a* through the bushing 326.

The shaft 328, shown in FIG. 25, is supported by a carriage 330, FIG. 19, connected with a tension-adjusting link 332 which permits position of the shaft to be adjusted for adjusting the tension of the chain member 322*a* in a known manner.

One of the sprockets of each pair of sprockets 324*a* and 324*b*, as shown in FIG. 26, comprises a free-running sprocket mounted on bearings 334, located at the ends of chain members 322*a* and 322*b*, opposite the driven sprockets provided therefor. These bearings also are supported for positional adjustment, by conventional chain-tensioning assembly 336, whereby chain tension may be varied.

The assembly 336 includes a suitable jack-screw assembly 338 coupled with a bearing support 339 provided for each of the free-running sprockets 324*a* and 324*b*. Consequently, by manipulating jack-screw 338 in a conventional manner, the position of the bearing support 339 is longitudinally adjusted for thus effecting a tension adjustment for the chain members 322*a* and 322*b*.

Accordingly, it should now be apparent that the chain assembly 322 includes a pair of chain components or members 322*a* and 322*b* and that the chain assembly is further characterized by an upper and a lower run defined by these members as they extend in parallelism with the longitudinal path defined by the track 214. Further, the pusher roller 320 is mounted between the chain components or members 322*a* and 322*b* and is supported to be advanced thereby along both the upper and lower runs of the chain assembly 322.

It should also be apparent that as the pusher roller 320 is driven along the upper run of the pusher chain assembly 322, the roller is seated near the upper end of the slot 318, and the truck 300 responsively is advanced in a first direction. Upon the roller 320 being caused to descend to the lower run of the pusher chain assembly 322, due to unidirectional advancement of the chain components or members, the roller 320 moves down and assumes a position within the lowermost end of the slot 318. Consequently, the truck 300 responsively is driven in a direction opposite to the direction. Thus, the roller is permitted to reciprocate within the slot 318 and experience a change in its direction of travel, as it moves between the upper and lower runs of the pusher chain assembly 322, for thus imparting reciprocation to the truck 300, and consequently the cleat 298 mounted thereon.

Figure 24:
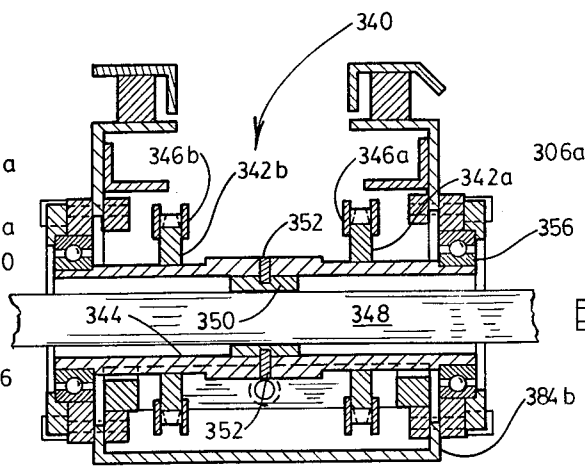
FIG. 24 is a sectional view taken generally along lines 24—24 of FIG. 19.

The power train for driving the sprockets 325*a* includes a driver assembly, generally designated 340, FIG. 19. This assembly includes a pair of drive sprockets 342*a* and 342*b* fixedly mounted, as by welding, on a sleeve 344, FIG. 24. The drive sprockets 342*a* and 342*b* each mate with a respective one of a pair of power chains, designated 346*a* and 346*b*. As shown in the power chain 346*a* also is trained about the drive sprocket 342*a* and the chain assembly driver sprocket 325*a*. Consequently, the drive sprocket 342*a* serves to drive the sprocket 325*a*, and through the bushing 326, serves to drive the sprocket 324*a*. In a similar fashion, the driven sprocket 324*b* is driven from the drive sprocket 342*b* of the driver assembly 340.

The drive sprockets 342*a* and 342*b* are, in turn, driven by a common power input shaft 348. This input shaft is of a square cross-sectional configuration and includes four flats, not designated, best shown in FIG. 19. The sleeve 344 is mated with the power input shaft 348 by means of a rigid, sleeve-like plug 350, seated on the shaft 348 and welded to the sleeve by plug-welds 354. The sleeve 344 is supported for rotation at each of its opposite ends by suitable bearing structures 356 so that rotation imparted to the shaft 348 is transmitted to the drive sprockets 342*a* and 342*b*.

Consequently, once the power chains 346*a* and 346*b* are advanced by the shaft 348, rotary motion is imparted to the sprockets 324*a* and 324*b* for the pusher chain assembly 322 for thus causing the pusher roller 320 to progress along the substantially rectilinear path for thereby imparting reciprocation to the truck 300. Thus the truck and the cleat 298 are driven in reciprocation between the opposite ends of the track 214.

The manner in which the cleat 296 for the conveyor 18*a* is supported and driven differs from the manner in which the cleat 298 is supported and driven only in that the cleat 296 is mounted on and depends downwardly from a truck 300', while the lost-motion plate employed in driving the truck 300' designated 312' projects upwardly. Consequently, the components employed in imparting reciprocation to the truck 300', and therefore the cleat 296, are designated with the same reference numerals used in designating like drive components for the truck 300. It is believed sufficient to appreciate that the cleats 296 and 298 are arranged in coplanar registry throughout the periods employed in case-pushing operations, as the trucks 300 and 300' are reciprocated in response to a simultaneous driven displacement of the plates 312 and 312' by the pusher rollers 320.

In view of the foregoing, it is believed that the structure employed in and the operation of the upper and lower conveyor components 318*a* and 318*b* is apparent. Therefore, a further discussion is omitted in the interest of brevity. It now should be understood that as the conveyor 18 is advanced, each case C is advanced along the track 214 from the case-squaring station 14 to the next-in-line or major flap-folding station 22.

(Minor Flap-Folding Station)

The flap-folding assembly 290, aforementioned, is supported upon a horizontal base member 358 mounted and adjustably positioned in a suitable way, not designated, but is provided in the block 262. The member 358 is secured in place relative to the way by a hand-operated knob-and-screw assembly 291, including a threaded set screw 291'.

Connected to the horizontal base member 358 is an upright member 360. A vertically displaceable block 362 is mounted on the upright 360 and is secured in place by means of an adjustable set screw 362' while a knob-and-screw assembly 364, having a knob 364', is provided for capturing a horizontally oriented, elongated base 366 of the flap-folding assembly 290. Thus the block 362 is provided for supporting the leading flap-folding assembly 290.

It is believed to be apparent that through the block 362, the assembly 290 is rendered adjustable in both vertical and horizontal directions since the block 362 is vertically adjustable on the upright 360, the base 366 of the assembly 290 is supported for horizontal adjustment, transversely with respect to the conveyor 18, and the base 358 is adjustable along the way, formed in the block 262, and each of the aforementioned elements is adapted to be secured in adjustment by tightening appropriate set-screws.

The flap $MF_1$ is knocked downwardly by a flap-folding subassembly 368, best shown in FIGS. 5 and 18, collectively. The assembly 368 includes a knocked-down, or flap-depressing rail member, herein referred to as a foot, 370, pivotally mounted on a shaft 372, via support links 373. The shaft 372, in turn, is connected to an actuating link 374 in a manner such that the axes of the link 374 and the rail member forming the foot 370 remain in a substantially fixed angular relationship. Hence, by imparting oscillation to the link 374, oscillating motion is imparted to the foot 370, through the shaft 372 and support links 373. The purpose for oscillating the foot 370 is to cause it to strike the upper major flap $MF_1$ and fold it downwardly toward the upper horns 392 of the minor flap-folding assembly 290 and into interfering relation with the minor flaps LF and TF.

In order to impart the desired oscillating motion to the link 374, there is provided a double-acting air cylinder 376 having a reciprocating output shaft connected at its distal end to the link 374, through a suitable bearing-supported eye, not designated. By energizing the actuator 376, the shaft thereof is extended for thus imparting a depressing motion to the link 374. This motion is, in turn, transmitted to the rail forming the foot 370 via the shaft 372, and support links 373, for "knocking" the flap $MF_1$ downwardly toward and into engagement with the upper horn 292 of the flap-folding assembly 290. The foot 370 momentarily holds the flap $MF_1$ against the horn 292 as the conveyor 18 advances the case C thus to cause the case to pass through station and enter the major flap-folding station 22.

(Conveyor Support Structure)

Figure 2:
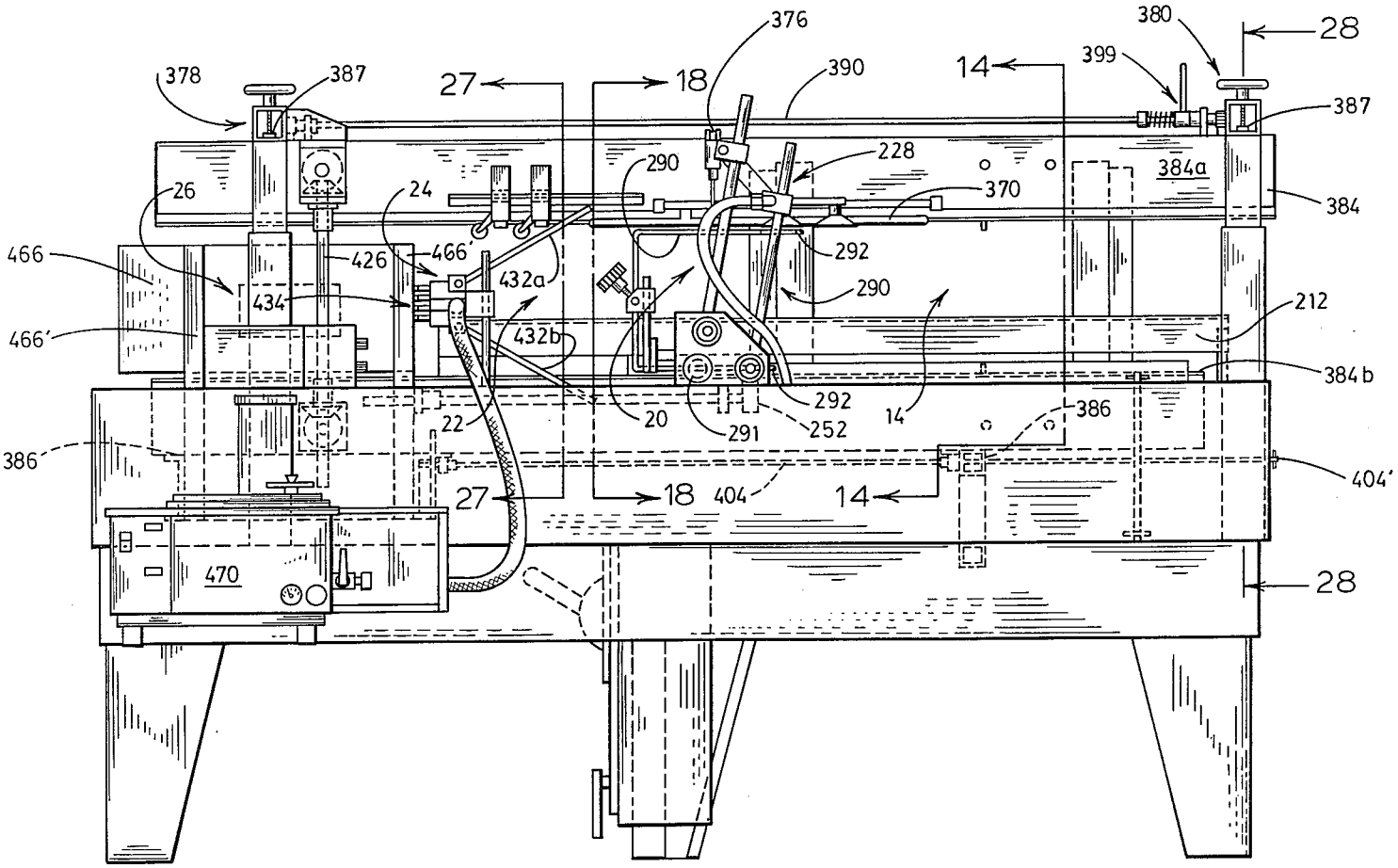
FIG. 2 is a rear elevational view of the machine.

As illustrated in FIG. 2, there is provided a pair of mast assemblies, designated 379 and 380 formed of box extrusions. The mast assemblies serve to support the upper portion of the conveyor 18*a*, mounted in a housing 384*a*, while the lower portion of the conveyor 18*b*, mounted in a housing 384*b*, is supported by a transverse support beam 386, having bearing surfaces 386', FIG. 6.

The housing 384*a* for the upper portion 18*a* of the conveyor 18 comprises an elongated, inverted, trough-like housing, FIG. 14, suspended near each of its opposite ends by one of the mast assemblies 378 and 380. Each of the mast assemblies includes a cross-arm, designated 378' and 380', FIG. 1. As best shown in FIGS. 6 and 12, the housing 384*b* for the lower portion 18*b* of the conveyor 18 is an upright, trough-like housing supported at each of its opposite end portions by the bearing surface 386' of the transverse support beams 386. Consequently, the upper housing 318*a* is supported for transverse motion by the mast assemblies 378 and 380, while the lower housing 384*b* is supported by the beams 386.

Figures 20, 21, 22, 23:
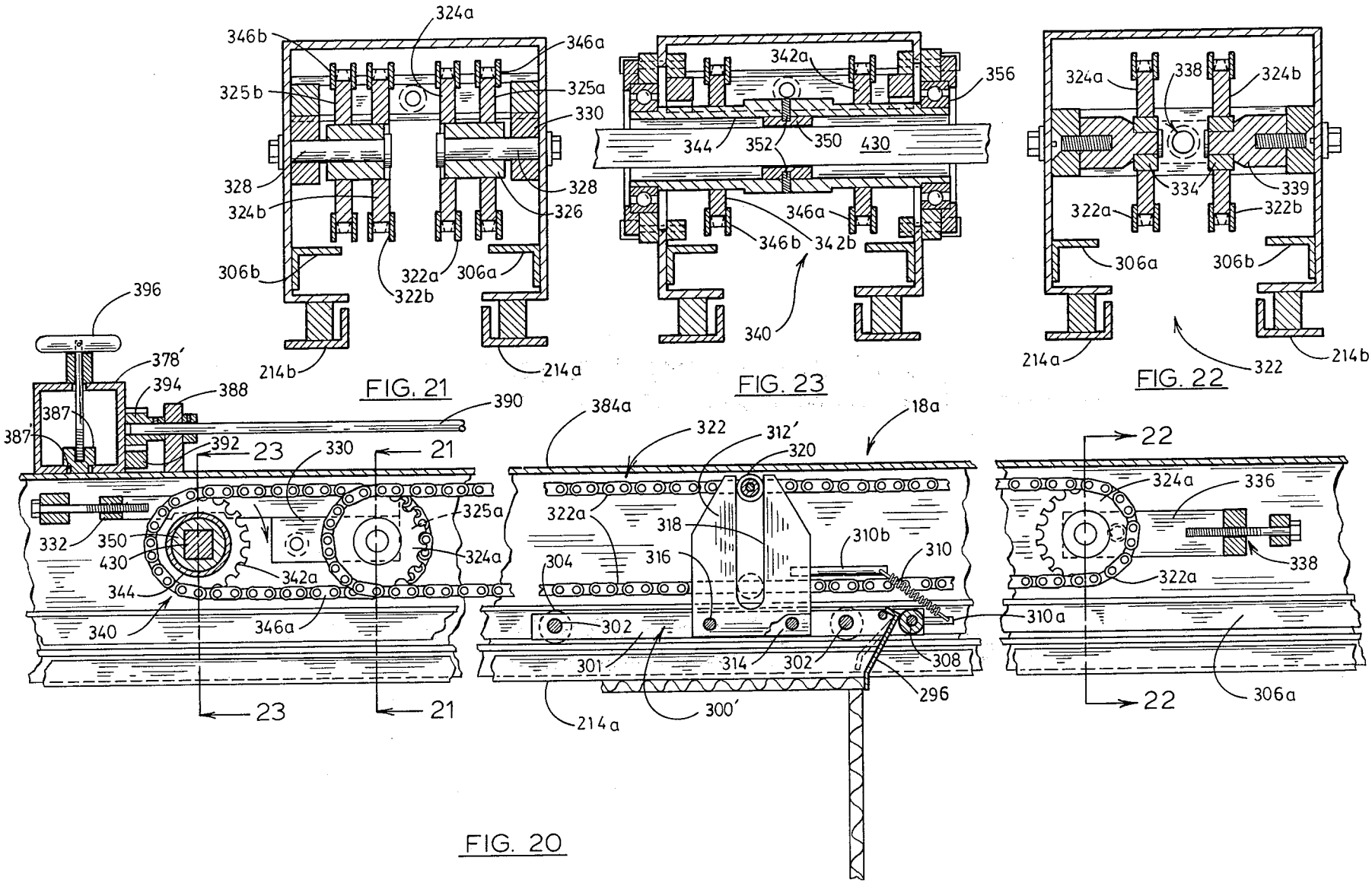
FIG. 20 is a vertically sectioned view of the conveyor, taken generally along lines 20—20 of FIG. 14, but depicting the case in an erected configuration.
FIG. 21 is a sectional view taken generally along lines 21—21 of FIG. 20.
FIG. 22 is a sectional view taken generally along lines 22—22 of FIG. 20.
FIG. 23 is a sectional view taken generally along lines 23—23 of FIG. 20.

The housing 384*a* functions as a mount for the conveyor components, FIG. 20, including the various sprockets, tensioning assemblies, and chains, as well as the truck 300', all aforedescribed. Similarly, the components of the conveyor portion 18*b* are mounted in the housing 384*b*. Thus, each of the conveyor portions 18*a* and 18*b* is deemed to be of modular construction and is adapted to be transversely displaced, relative to the case-advancing path, as defined by the conveyor 18.

Since the mast assemblies 378 and 380 are of similar design and construction and function in a similar manner, a description of the mast assembly 378 is deemed adequate to provide for a complete understanding of the assemblies.

Figure 28:
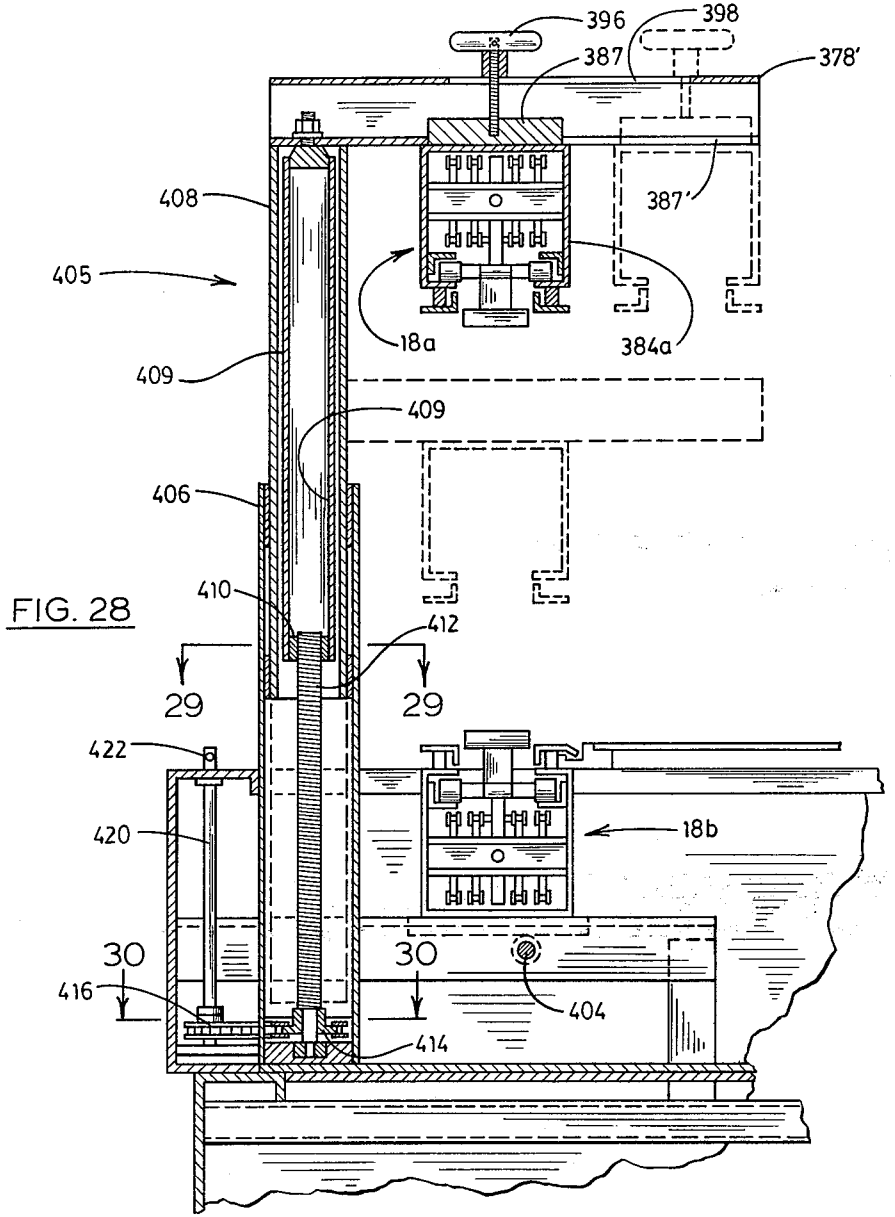
FIG. 28 is a sectional view taken generally along lines 28—28 of FIG. 2, depicting alternate positions for the upper portion of the conveyor shown in FIG. 20.
Figure 31:
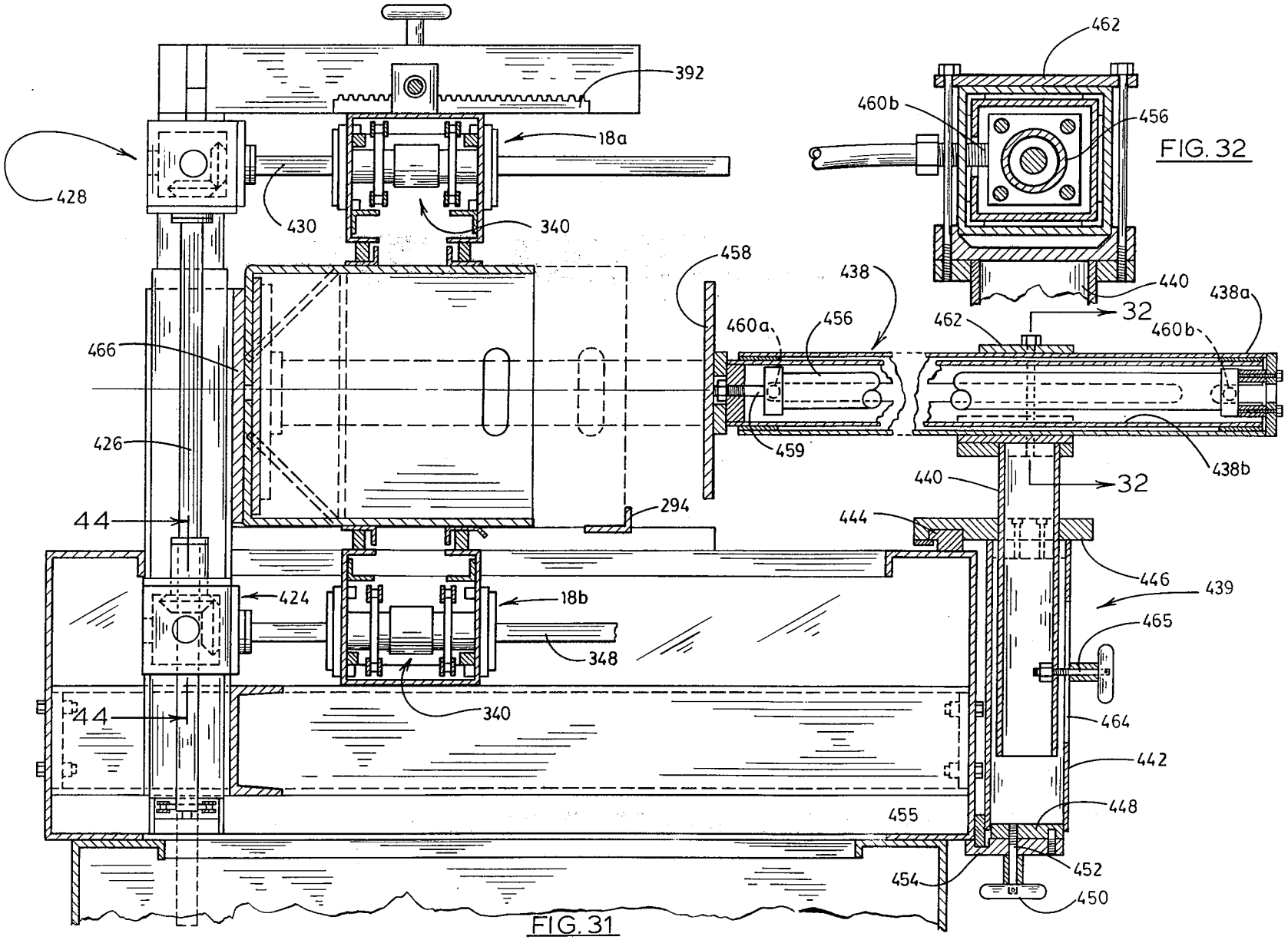
FIG. 31 is a vertically sectioned view taken generally along lines 30-31 of FIG. 5, depicting an erected case at the case compression station for the machine.

The housing 384*a* is suspended at each of its opposite ends through a use of a sliding T-bar 387, FIGS. 20 and 28, positioned in a slot 387' formed within the mast assemblies, and a link 388 provided for coupling the housing in suspension with a traveling rod 390. A rack 392, FIG. 31, is welded to the cross arm 278' of mast assemblies and receives therein a pinion 394, FIG. 5, mounted on the traveling rod 390. The T-bars 387 are adapted to be secured in place, relative to the mast assemblies, by means of hand wheels 396 having shafts extended through slots 398 and received within the T-bars 387. Since the housing 384*a* is suspended from the T-bar, the position of the housing may be fixed simply by tightening the hand wheels 396 for drawing the housing into tight frictional engagement with the undersurface of the mast assemblies. Preferably, a ratchet 399, FIG. 2, is provided for applying torque to the traveling rod 390 for thus rotating the pinion 394 and advancing the conveyor portion 18*a* along the transverse axis of the machine.

It can be seen from a comparison of the support beams 386, as shown in FIG. 2, the shapes of these beams differ at the opposite ends of the conveyor 18. However, the function and manner in which the beams serve to support the conveyor portion 18*b* is essentially the same. Therefore, a description of a single beam 386 is deemed adequate to provide for a complete understanding of the invention.

Each of the opposite end portions of the housing 384*b* for the lower portion 18*b* of the conveyor 18 is connected with a rack 400, FIGS. 6 and 12, mated with a pinion 402, mounted on a housing-positioning shaft 404. As shown in FIG. 16, the shaft 404 extends between the support beams 386 and is supported for rotation thereby. Consequently, by applying torque to the shaft 404, the racks are advanced for thus advancing the housing 384*b*, whereupon the lower portion 18*b* of the conveyor 18 is displaced transversely of the machine. While not designated, where desired, suitable means are provided for securing the housing 384*b* in an adjusted position. As shown in FIG. 2, a T-handle 404 serves as a suitable device for imparting torque to the shaft 404.

Each of the cross-arms for the mast assemblies 378 and 380 is bolted, welded and/or otherwise secured to a telescoping pedestal 405 and is rendered vertically adjustable by including therein an upright comprising a base 406, FIG. 28, and a telescoping distal portion 408 received by the upright. The distal portion 408 is provided with a ram 409, concentrically related to the portion 408, having an internal nut 410 threadably receiving a jack-screw 412, comprising an upright, screw-threaded shaft. By imparting rotation to the jack-screw 412, the distal portion 408 is elevated and lowered, as is necessary, for accommodating changes in size of cases being run through the machine.

Figure 30:
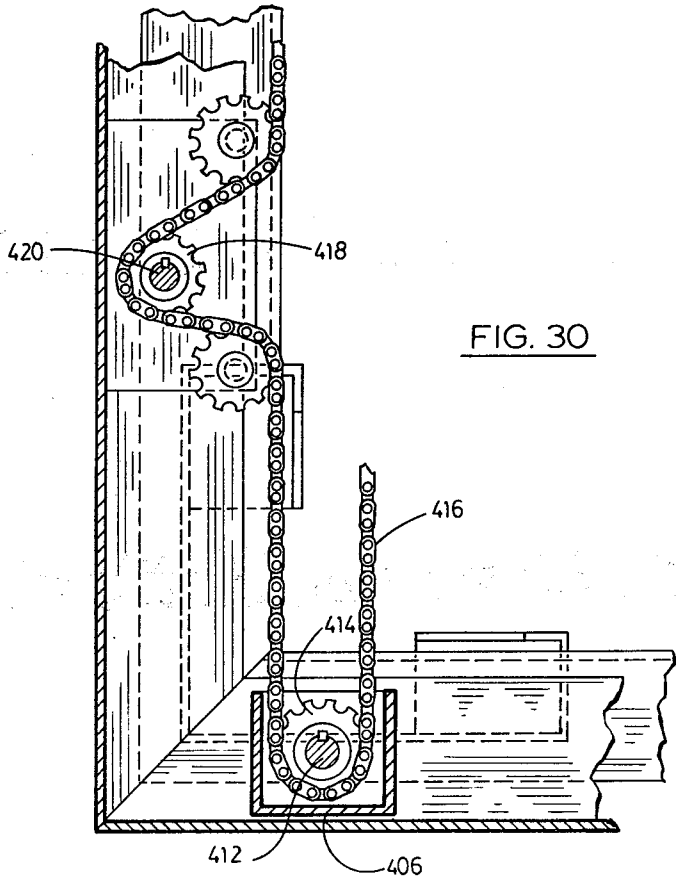
FIG. 30 is a horizontally sectioned view taken generally along lines 30—30 of FIG. 28.

In order to impart rotation to the shaft of the jack-screw 412, for each mast assembly, there is provided for the shaft of each, a sprocket wheel 414 around which is trained a chain 416, FIGS. 28 and 30. The chain 414 is also trained about a drive sprocket 418, connected with a manually operable shaft 420. The shaft 420 is provided with a T-handle fitting 422 whereby torque may be applied thereto and transmitted to the shafts 412 simultaneously, through the chain 416, for selectively elevating and lowering the pedestals 405 of the mast assemblies 378 and 380.

(Coupling For Drive Conveyor)

Referring for a moment to FIG. 31, it is also important to note that the shaft 348 extends through the lower portion 18*b* of the conveyor to a bevel-gear assembly 424 having an output shaft 426 disposed at an angle of 90° with the shaft 348 and adapted to serve as an input shaft to a bevel-gear assembly 428. The assembly 428 includes an output shaft 430 normally related to the shaft 426 and adapted to drive the driver assembly 340 for the upper portion 18*a* of the conveyor. Thus, the conveyor portions 18*a* and 18*b* are adapted to be driven simultaneously.

Figure 44:
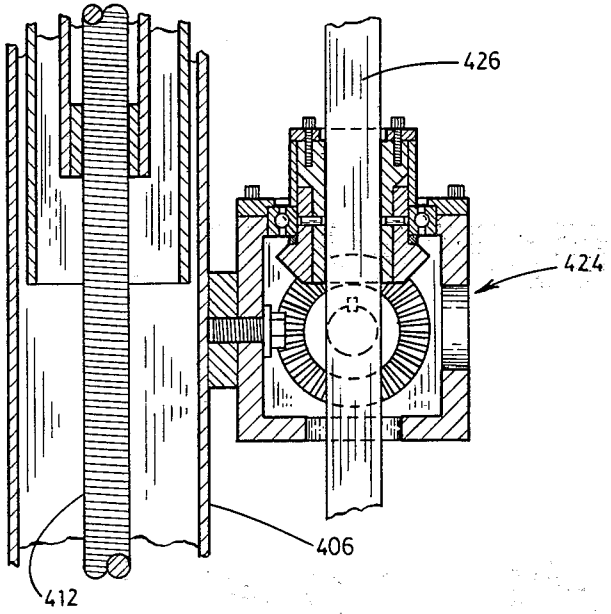
FIG. 44 is a vertically sectioned view taken generally along lines 44—44 of FIG. 31.
Figure 42:
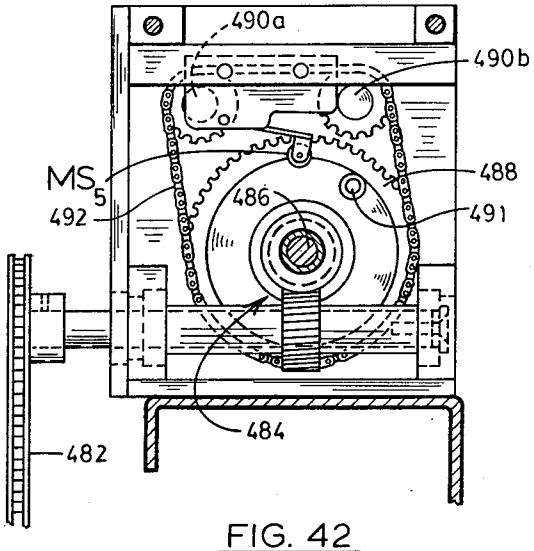
FIG. 42 is a vertically sectioned view taken generally along lines 42—42 of FIG. 41.
Figure 43:
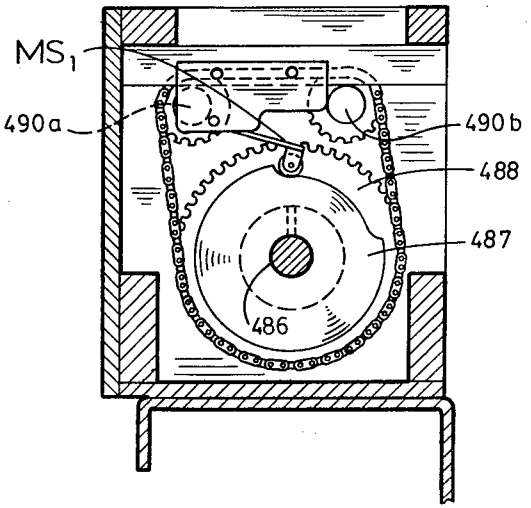
FIG. 43 is a vertically sectioned view taken generally along lines 43—43 of FIG. 41.

Referring now to FIG. 44, it is noted that the shaft 426 is adapted to be extended downwardly through the bevel-gear, not designated, mated therewith whereby vertical positional adjustment of the mast is accommodated.

It is believed that in view of the foregoing, it can be appreciated that each portion of the conveyor, 18*a* and 18*b*, is adapted to be positionally adjusted relative to the transverse axis of the machine 10, while the mast assemblies 378 and 380 are adapted for simultaneous adjustment in vertical planes. Thus the machine 10 is adapted to be adjusted suitably for handling cases of different sizes for thus enhancing the versatility thereof.

(Major Flap-Folding Station)

With reference to FIG. 2, as the cases exit the minor flap-folding station 20, they serially are accepted at the major flap-folding station 22.

The major flap-folding station 22 is provided with a pair of flap folding plows, designated 432*a* and 432*b*. The purpose of the plows is to complete the down-folding operation of the flap $MF_1$ and an up-folding operation of the flap $MF_2$. The plows 432*a* and 432*b* generally are of a conventional design in that they converge in a horizontal downstream direction. The plow 432*a* extends above the level of the flap $MF_1$ and engages it as it is released by the foot 370, while the plow 432*b* extends below and engages the lower flap, and then up-folds the flap, subsequent to its being released from the pneumatic cups, to progress through the machine. Thus, the flaps are in-folded toward a case-closing configuration by the plows 432*a* and 432*b*.

It is important to note that as the plows converge, they converge toward a pressurized glue applicator head 434 of commercially available design. This head possesses a capability for delivering extruded beads of hot glue, delivered thereto through a suitable conduit 436, in a variety of patterns. A commercially available applicator having a head which serves satisfactorily, as sold by the Nordson Corporation, of Amhert, Ohio, is a Nordson Hot-Glue Applicator. Since the details of the glue applicator head form no part of the claimed invention, a detailed description thereof is omitted in the interest of brevity. At this juncture, it is sufficient to understand that as the flaps MF1, MF2, LF, and TF progress through the major flap-folding station 22, they enter the glue applicator station 24, see FIGS. 27 and 48E, at which station glue is applied to the flaps at locations suitable for establishing a film of glue between contiguous surfaces.

(Compression Station)

As the cases C exit the station 24, they are delivered by the conveyor 18 to the compression station 26.

The compression station 26 is provided with a compressor ram assembly 438. With reference to FIG. 31, the compressing ram assembly 438 is supported by an adjustable pedestal 439. This pedestal includes an upright support 440 telescopically received within a base 442 and horizontally supported by a guide rail 444 and a yoke 446. The rail 444 accommodates horizontal adjustment of the pedestal 439 along a path paralleling the longitudinal axis of the conveyor 18. As a practical matter, a locking plate 448 is provided in the bottom of the base 442, while a hand wheel 450 equipped with a threaded shaft 452, is screw-threaded into a bore, formed in the plate 448, slidable along a fixed guide rail 455, whereby a frictional locking of the pedestal relative to the guide rail is achieved. A tightening of the shaft 452 secures the pedestal relative to a base plate 454, provided for supporting the pedestal.

Consequently, by releasing the shaft 452, relative to the plate 448, the base 442 may be slidingly advanced along the guide rail 455, as well as the guide rail 444, in order to reposition the ram assembly 438 in an operative position relative to the path of the conveyor 18.

The compressor assembly 438 includes telescoping segments 438*a* and 438*b* within which is disposed a double-acting pneumatic ram 456. The assembly 438 is mounted on the pedestal 439 and is provided with a compressor plate 458 connected to the output shaft 459 thereof. The ram 456 includes pressure ports 460*a* and 460*b* for controlling the pressurization thereof. In practice, a suitable saddle 462 is provided for connecting the assembly 438 with the pedestal.

Preferably, the base 442 is provided with a slot 464 through which extends the shaft of an adjusting screw 465 which permits the vertical position of the upright to be adjusted relative to the base 442, in a conventional manner. That is to say, upon a loosening, the screw 465, the upright support 440 is released for vertical displacement. A subsequent tightening of the screw 465 serves to lock the support 440 against displacement.

Provided at the compression station, in opposition to the plate 458, is a platen 466 so positioned relative to the path of the plate as to engage the outer surfaces of the flaps of each case for purposes of effecting a sealing thereof as the plate 458 is sequentially inserted into each case serially delivered to the compression station. As the plate 458 is retracted from the case C, the case assumes its erected configuration, whereupon it is prepared to be discharged from the machine 10 in response to continued motion of the conveyor 18. The plate 458 is supported by uprights 466, rigidly connected to the frame F, FIG. 2.

It now will be appreciated that the compression station 26 is so situated relative to the conveyor that the conveyor serially positions each case within the path of the ram as advancing motion for the case occurs so that each case, in effect, simultaneously is positioned at the compression station while another is dropped-off the conveyor. Once the compression has been completed, successive cases serially advanced to the compression station serve to discharge the completed or erected case from the machine.

It should now be apparent that the knocked-down cases are fed from the hopper 12, expanded and then conveyed by the conveyor 18 through the machine 10 to be discharged from the machine in a completed or erected configuration with the flaps thereof being sealed at one end thereof.

(Glue Applicator)

It is to be understood that the glue applicator, as aforementioned, is of a known design. Accordingly, the details thereof form no part of the claimed invention. It suffices to understand that the applicator is provided with a glue-control unit 470, the purpose of which is to control the application, as well as the pattern in which hog glue is applied to the flaps of each successive case. While beads of glue are applied to the case flaps through the head 434, delivery of glue to the head is accommodated through a glue valve 471. Operation of this valve is controlled by a solenoid 471'.

Figure 41:
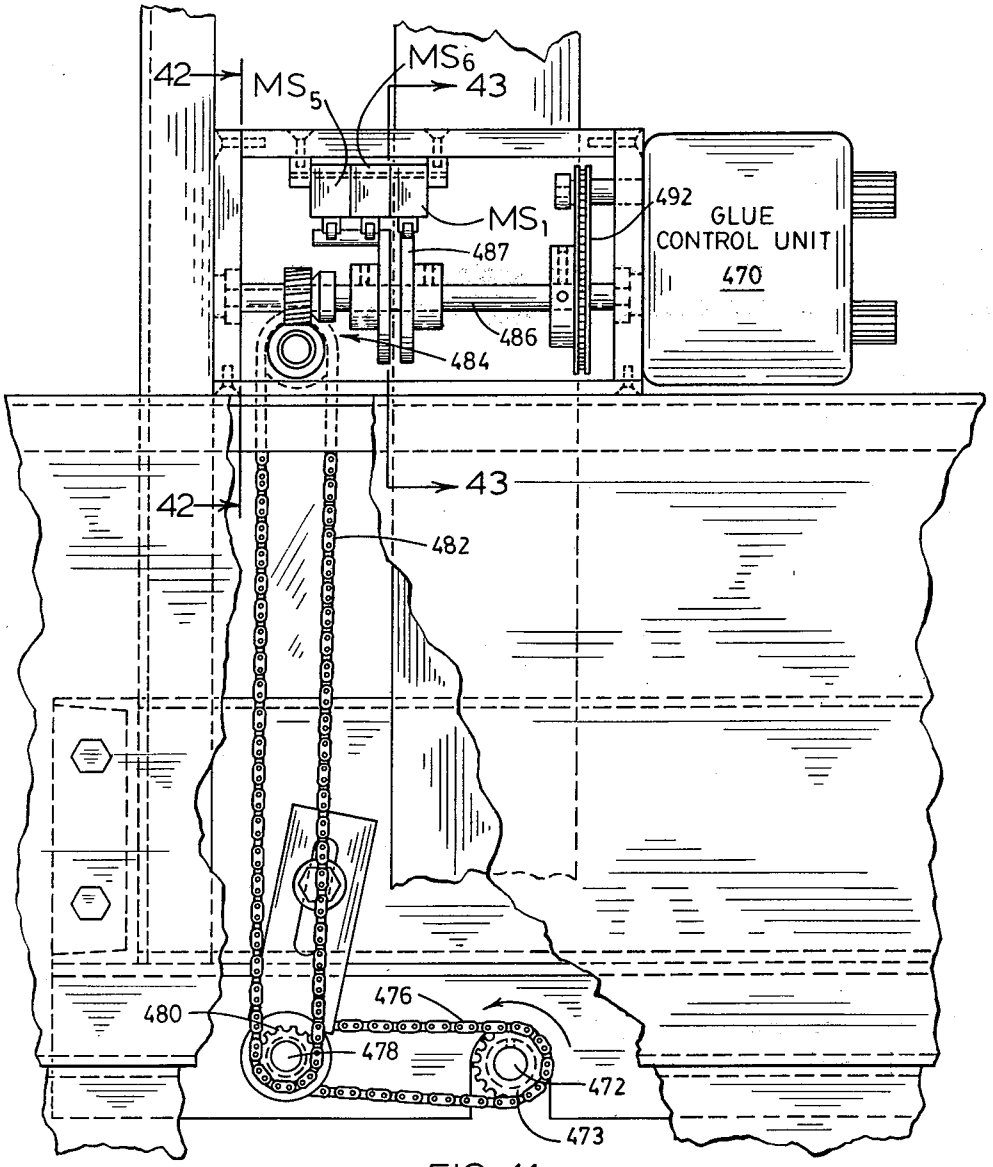
FIG. 41 is a vertically sectioned, fragmented view taken generally along lines 41—41 of FIG. 5, but on an enlarged scale.

The machine 10 provides for a mechanical input to a glue applicator circuit, the control of which is achieved both mechanically and electrically. An electric control circuit for the unit 470 is provided to function with mechanical motion derived from a main drive shaft 472. The shaft 472 is provided with a sprocket wheel 473 connected with a sprocket 474, through a chain 476, FIGS. 33 and 41, mounted on a floating shaft 478. The shaft 478 also serves to mount a sprocket wheel 480 which is, in turn, connected with a glue unit drive chain 482. This chain is connected through suitable sprocket wheel couplings and gearing 484 to a glue unit drive shaft 486, provided as a mechanical input for the glue control unit 470.

Mounted on the shaft 486 is a cam 487 adapted to operate a microswitch $MS_1$ adapted to control the cycle of operation for the solenoid-actuated valve 471. A ring gear 488 is coupled with cam control shafts 490*a* and 490*b* through a suitable chain 492, for cam actuated switches $MS_2$ and $MS_3$, provided for controlling the initiation of the application of the beads of glue. Microswitches $MS_4$ and $MS_5$ serve to interrupt the glue cycle, $MS_4$ in the event no box is present, $MS_5$ once each cycle of operation, as can be seen from FIG. 49. $MS_4$ and $MS_5$, of conventional design, are located within the unit 470 and are controlled by cam actuator 491 in order to maintain an energized state for the master control relay when $MS_4$ is open. The switch $MS_4$ is provided with a box sensor mounted in the path of the cases and adapted to be actuated thereby, as illustrated in FIG. 16. Should $MS_4$, $MS_5$, and $MS_6$ open simultaneously, the master control relay, FIG. 49, interrupts operation of the machine. As a matter of interest, switch $MS_3$, FIGS. 16 and 49, functions as a box-present sensing switch. In the absence of a box at the glue applicator station, the box sensor for the switch remains unactuated so that the circuit through the glue solenoid coil remains open in order to impose a state of quiescence on the solenoid valve 471, even though the machine continues to function.

Again, while the details of the glue applicator circuit form no part of the claimed invention, it can be appreciated that the sensor cams and the cam followers simply serve to interrupt suitably positioned microswitches adapted to control the delivery of glue through the glue applicator head 434. Since the machine 10 may be wired in a variety of ways to achieve the same result, a detailed discussion of the wiring diagram of FIG. 49 is omitted.

(Machine Drive)

Figure 33:
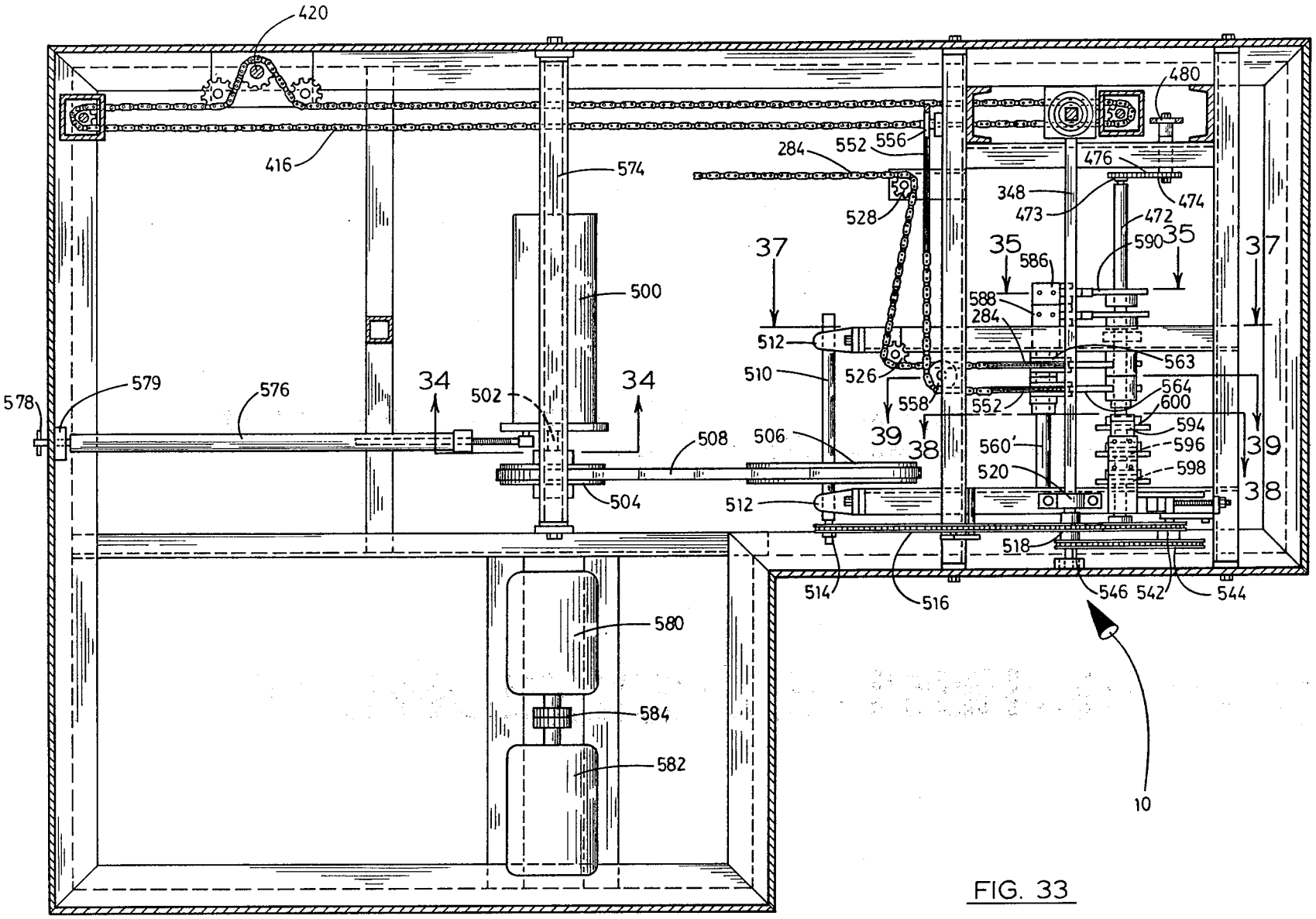
FIG. 33 is a horizontally sectioned view taken generally along lines 33—33 of FIG. 1.
Figure 36:
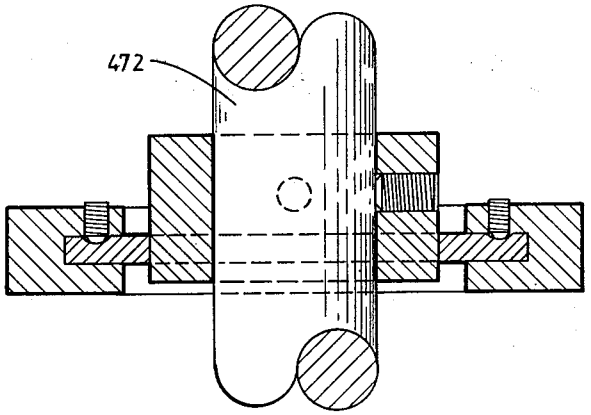
FIG. 36 is a fragmented view taken generally along lines 36—36 of FIG. 35, but for the sake of clarity depicting a drive shaft for the glue applicator station in full.

Referring for a moment to FIG. 33, it can be seen that an electrical motor 500, having a starter coil $CR_3$, FIG. 49, is provided for supplying mechanical power to the aforementioned main drive shaft 472 for the machine 10. The motor 500 includes an output shaft 502 upon which is mounted a variable diameter/variable speed sheave or pulley 504. This pulley is coupled with a main drive pulley 506, through a suitable V-belt 508, mounted on a main drive shaft 510. The shaft 510 is supported by pillow bearings 512 for driven rotation imparted thereto by the motor 500 through the pulleys aforementioned.

Figure 37:
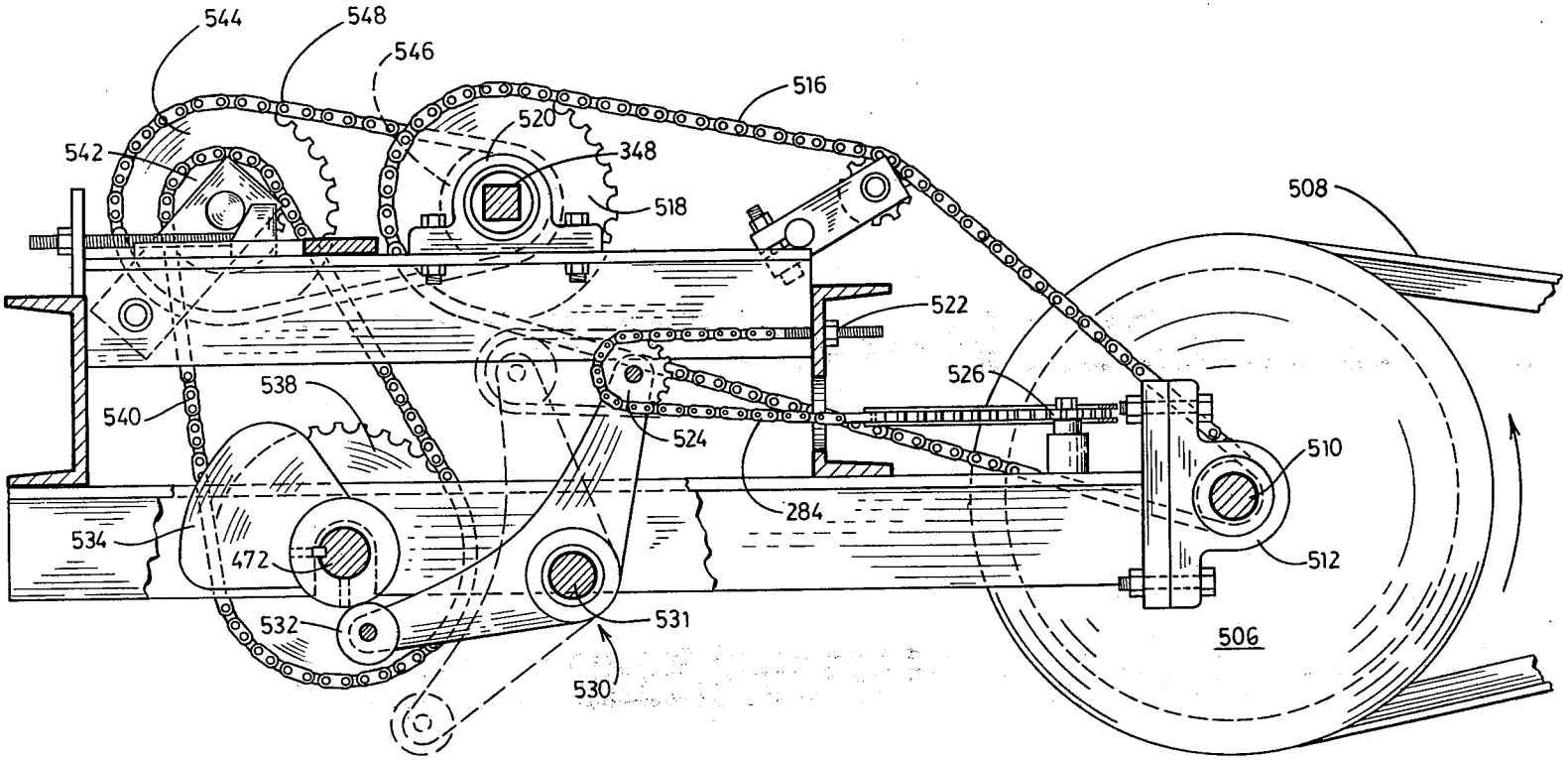
FIG. 37 is a vertically sectioned view taken generally along lines 37—37 of FIG. 33.

As also shown in FIG. 33, a sprocket wheel 514 is affixed to the shaft 510 and connected through a chain to a sprocket wheel 518, FIG. 37, which is, in turn, rigidly mounted on the aforementioned drive shaft 348 for the conveyor 18. As a practical matter, it can be seen that the shaft 348 is supported by pillow bearings 520, mounted on a suitable support, not designated. Consequently, it should now be apparent that the conveyor is driven from the motor 500 via the pulleys 504, 506 and sprocket wheels 514 and 518, via the chain 516.

Also with reference to FIGS. 33 and 37, it can be seen that the chain 284 is connected at its end, through a suitable anchor coupling 522, to a frame member for the machine 10, not designated. The chain 284 also is trained about a floating chain tensioning sprocket wheel 524 and thence about a fixed sprocket wheel 526. The sprocket wheel 524 functions as an actuator while the sprocket wheel 526 serves to change direction of travel for causing the chain to advance toward a further sprocket wheel 528. From the sprocket wheel 528, the chain 284 passes to the sprocket wheels 285*a* and 285*b* and thence to the sprocket wheel 283, aforedescribed.

It will be recalled that, in operation, the chain 284 is periodically tensioned. Tensioning of the chain 284 is achieved by mounting the sprocket wheel 524 on the extended end of one arm of a pair defining a bell crank assembly 530 mounted on a pivot 531. The opposite arm of the assembly is provided with a cam follower 532 adapted to be lifted by a rotatable cam 534 pinned to the main drive shaft 472.

The drive shaft 472 is mounted and connected to be driven through a sprocket wheel 538 and a chain 540 connected to a sprocket wheel 542 driven, in turn, by a sprocket wheel 544 connected with a sprocket wheel 546, through a chain 548, mounted on the shaft 438. Hence, as rotation is imparted to the shaft 438 for thus driving the conveyor 18, rotation is imparted to the main drive shaft 472.

Thus, the main drive shaft 472 drives the cam 534 for causing it to engage periodically the cam follower 532 whereupon a pivoting of the bell crank assembly 530 about its axis is effected. Such causes the sprocket wheel 524 to be displaced horizontally with a responsive tensioning of the chain 284. This periodic tensioning of the chain 284 is for purposes of achieving a raising and actuation of the striker assembly 234, in a manner hereinbefore described.

Figure 39:
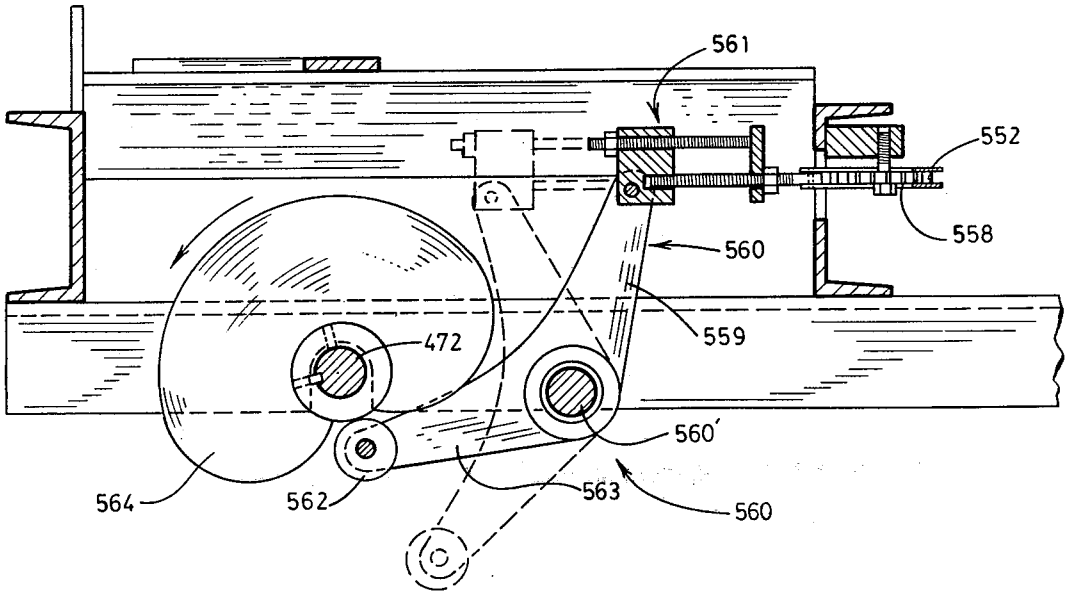
FIG. 39 is a vertically sectioned view taken generally along lines 39—39 of FIG. 33.
Figure 40:
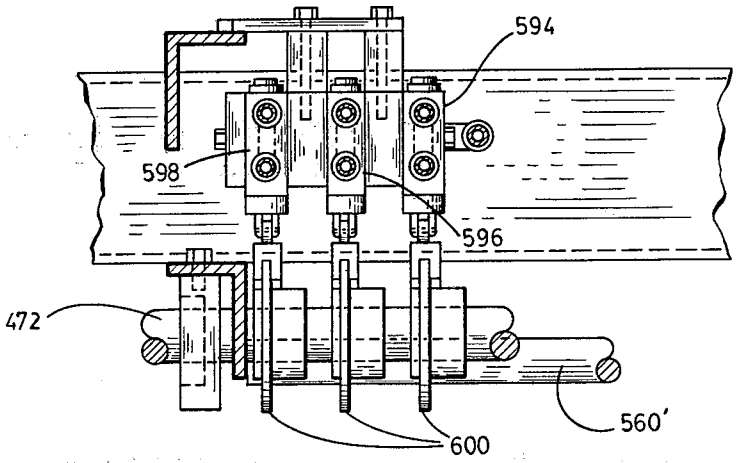
FIG. 40 is a vertically sectioned view taken generally along lines 40—40 of FIG. 38.

Referring again for the moment to FIG. 16, it can be seen that the helical gear 252 is mounted on the drive shaft 258. Rotation is imparted to the shaft 258 via a sprocket wheel segment 550, FIG. 16, mounted on the shaft 258 in fixed relation therewith. A chain 552 having one end connected to the sprocket segment 550, FIG. 27, is trained about a pair of free-running, motion direction-changing sprocket wheels, designated 554 and 556, and thence about a motion changing sprocket wheel 558 to be connected with one arm 559 of a further bell crank assembly 560, FIG. 39, mounted to pivot about a pivot 560', via an adjustable anchor block 561.

The bell crank assembly 560 is provided with a cam follower 562 mounted on the opposite arm 563, adapted to be displaced by a cam 564. This cam is mounted on the shaft 472 so that periodically the bell crank assembly 560 is pivotally displaced for thus periodically tensioning the chain 552. The tensioning of the chain 552 serves periodically to impart angular displacement to the sprocket wheel segment 550, which motion is, in turn, transmitted through the shaft 258 to the gear 254 for thus imparting actuating motion to the parallel linkage 238.

In order to reverse the direction of rotation imparted to the shaft 258, in the aforedescribed manner, a spring-loaded chain 566 is connected at one end to the sprocket wheel segment 550, FIG. 14. The opposite end of the chain 566 is connected to a spring 568, FIG. 16, after passing around a direction-changing sprocket wheel 570. Thus the chain 566 is tension spring-loaded.

As the drive shaft 258 is rotated in a first direction, in response to a tensioning of the chain 552, the spring 268 becomes effective for applying a force to the sprocket wheel segment 550 in order for the shaft 258 to rotate in reverse rotation. Upon the tension being removed from the chain 552, reverse rotation is imparted to the shaft. Thus the parallel linkage 238 is periodically activated by the motor 500 and a cycle of operation imposed thereon.

Figure 34:
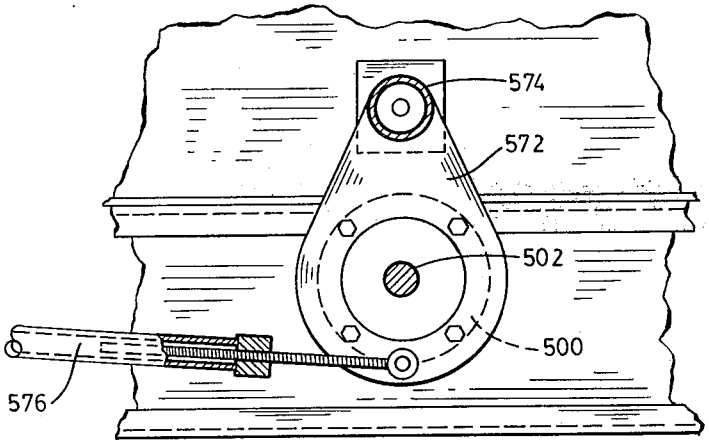
FIG. 34 is a vertically sectioned view taken generally along lines 34—34 of FIG. 33, depicting a portion of the drive mechanism for the machine.

As best shown in FIGS. 33 and 34, taken collectively, the motor 500 is mounted on and supported by a pivotal bracket 572. Bolts, not designated, four of which are shown in FIG. 34, are used for this purpose. The bracket 572 is suspended from an elongated mount comprising a pivot bar 574, whereby the bracket 572 comprises, in effect, a pendulous support for the motor 500.

It also is important to recall that the pulley 504 comprises a variable effective diameter pulley through which speed change is achieved simply by changing the effective size of the pulley. This is achieved by changing the tension on the belt 508, in a known manner. Hence, a motor position control bar 576 is connected to the bracket 572 and is adapted adjustably to be reciprocated for arcuately displacing the shaft 502 of the motor 500, whereby the effective diameter of the pulley 504 is varied for thus varying or adjusting the speed at which the pulley 506 is driven by the motor. A T-handle 578 is provided externally of the machine 10 for accommodating an adjustment position of the bar 576. In practice, the T-handle includes a screw-threaded shaft seated in an internally threaded bore 579, whereby torque applied to the T-handle 578 serves to advance the bar 576 to an axial direction.

(Negative Pressure System)

Figure 47:
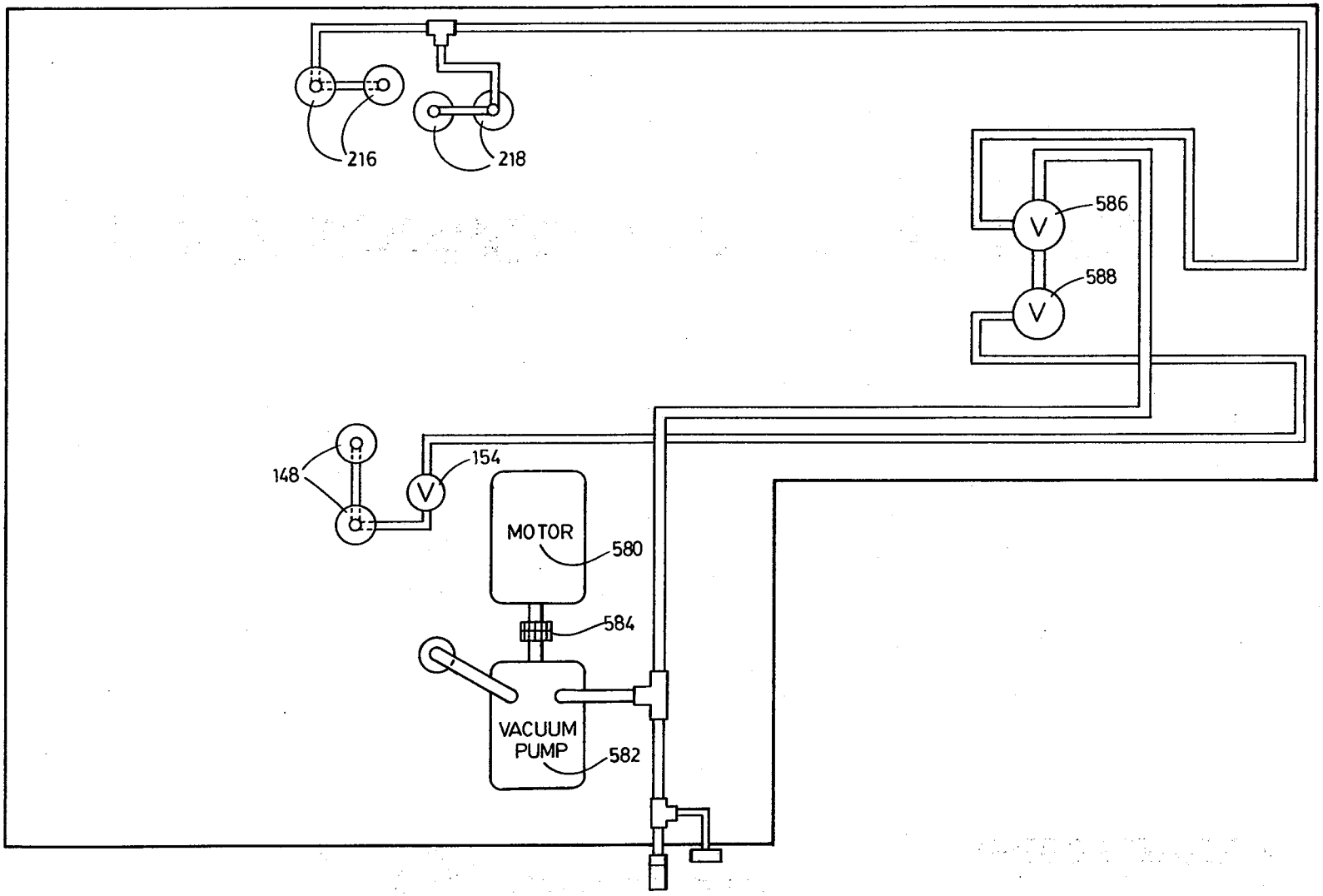
FIG. 47 is a schematic view depicting a vacuum, or negative pressure portion of the pneumatic system provided for the instant invention.

An additional motor 580, FIG. 47, is provided for driving a vacuum pump 582, provided for the machine 10. This is effected through a suitable coupling 584.

The purpose of the vacuum pump 582 is, of course, to generate the vacuum necessary for operating the system shown in FIG. 47.

It is to be understood that the vacuum circuit depicted in FIG. 47 is of a substantially known design and is provided with flow control valves, filters, lubricating valves and quick discharge valves, all of which are known in terms of function and structure, but none of which is shown, for the sake of brevity. Since these devices are well within the purview of the art and the details thereof form no part of the instant invention, a detailed description thereof is omitted.

Figure 35:
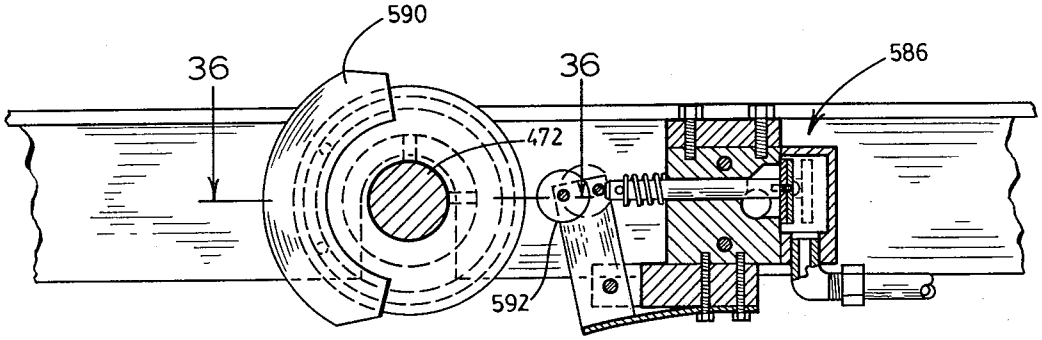
FIG. 35 is a vertically sectioned view taken generally along lines 35—35 of FIG. 33, depicting a typical cam-operated valve for the pneumatic system provided for the instant invention.

With reference to FIG. 47, it can be seen that a first cam-actuated valve 586 is provided for controlling the vacuum applied to the pneumatic cups 216 and 218, at station 14, while a cam-actuated valve 588 is provided for applying vacuum to the cups 148 via the valve 154, at the pickers of the case-transfer station 16. With reference to FIG. 35, the valve 586 is illustrated and is considered illustrative of both of the valves. It is noted that adjacent the valve 186 there is mounted on the shaft 472 a cam 590 provided for actuating a cam follower 592, connected to the valves 586 for thus periodically interrupting vacuum conveyed therethrough. Hence the periods during which the valves 586 and 588 are energized is determined by the period of rotation for the cams 590.

(Positive Pressure System)

Figure 38:
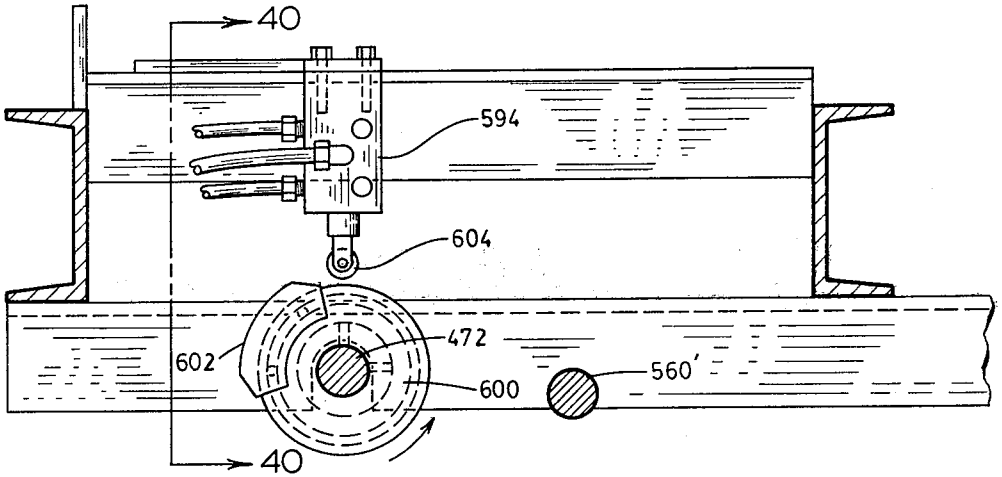
FIG. 38 is a vertically sectioned view taken generally along lines 38—38 of FIG. 33.
Figure 46:
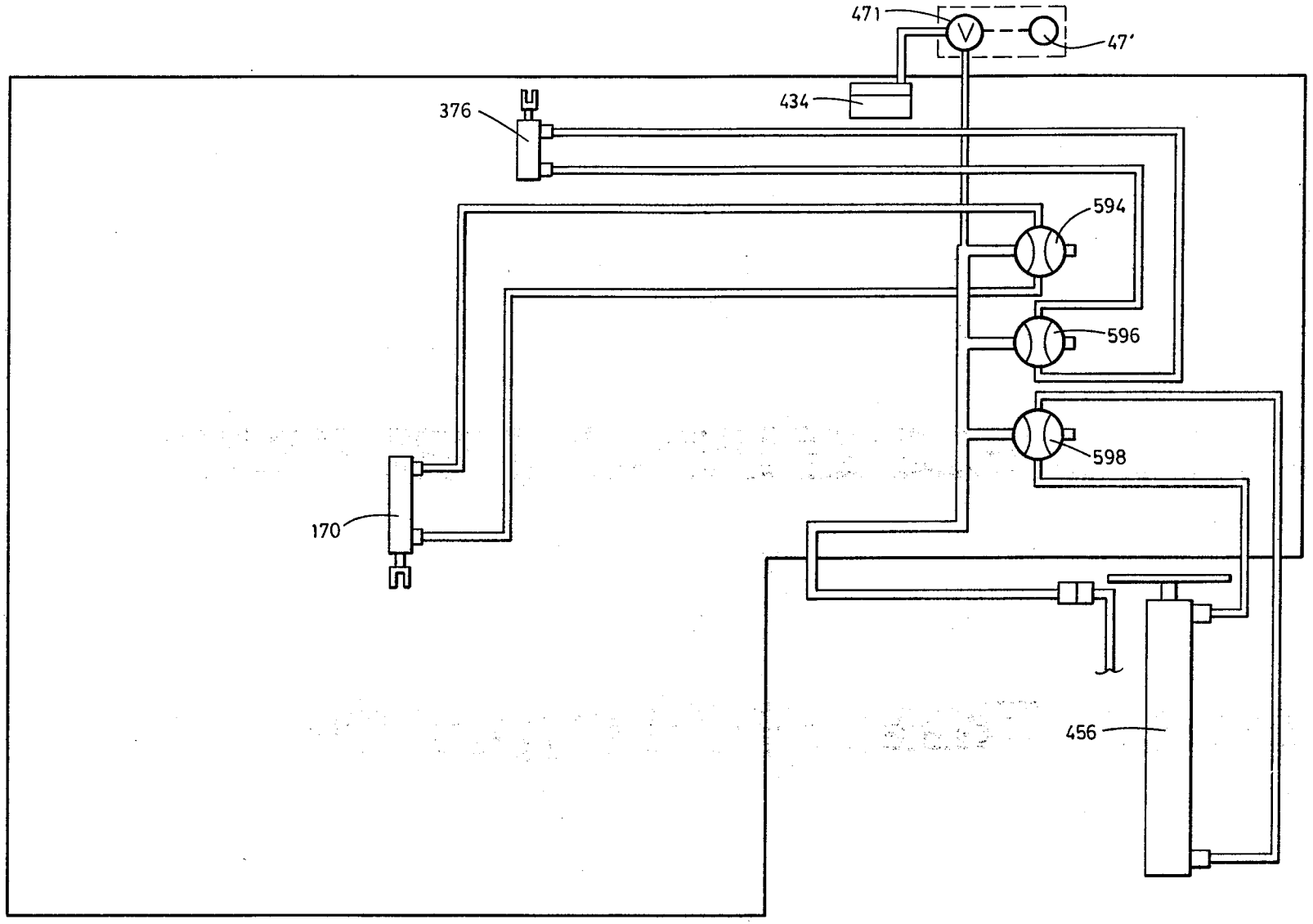
FIG. 46 is a schematic view depicting a positive pressure portion of the pneumatic system provided for the instant invention.

Referring to FIGS. 38 and 46, collectively, it can be seen that the pneumatic, or air cylinder 170 for the transfer station 16, the cylinder 376 for the major flap-depressor foot 370, as well as the pneumatic cylinder for the ram 456, of the compression station 26 are controlled through cam-actuated valves 594, 596 and 598, of a known design. It is noted that the pneumatic cylinder 170 is controlled through a four-way valve 594, the pneumatic cylinder or actuator 376 is controlled through a pneumatic valve 596, while the pneumatic cylinder for the ram 456 is controlled through a four-way valve 598.

These valves are typified by the cam-actuated valve, designated 594, in FIG. 38. As shown in FIG. 38, a cam 600 mounted on the shaft 472 is provided with a cam surface 602, extended along 60° of its periphery. This surface is adapted to engage a cam follower 604 for switching the valve 594 in a manner well understood by those familiar with such devices.

Additionally, the solenoid-actuated valve 471 is used in a conventional manner for delivering air under pressure to the glue head 434. Of course, operation of the valve 471 is controlled by the glue control unit 470 which forms no part of the instant invention, but is deemed to be well within the purview of the art.

(Electrical)

The details of the control circuitry employed for controlling the operation of the machine 10 form no part of the instant invention and are, in practice, varied as desired. Accordingly, while the circuitry currently employed is diagrammatically illustrated in FIG. 49, through a simplified ladder diagram, a detailed description of the circuitry illustrated is omitted in the interest of brevity.

It is believed sufficient to appreciate that the circuit, in addition to the components previously discussed, includes a MASTER RELAY coil CR-1 for a master relay, which when de-energized "shuts down" the machine 10; a starter coil CR-2 for VACUUM MOTOR 580 and its windings; and a drive motor starter coil CR-3 for DRIVE MOTOR 500 and its windings.

The circuit is suitably switched, as illustrated, using both manual and cam-operated switching components, as desired, to achieve desired operational timing and other conventionally required results.

In summary, the circuit is energized via a transformer T; a DRIVE MOTOR (500) powers the machine; a VACUUM MOTOR (580) serves to drive the vacuum pump 582 and thus energizes the negative pressure circuit; a MASTER CONTROL RELAY (not shown) serves to shut-down the machine in the event switches $MS_4$, $MS_5$, and $MS_6$ open simultaneously, at a point in the machine's cycle when no box is present at the glue-applicator station 24; and the GLUE SOLENOID COIL for the valve 471 courses a glue bead to be applied via the glue head when either of the normally open switches $MS_2$ or $MS'_3$ is closed in series with $MS_1$ and $MS_3$ in a closed condition.

In view of the foregoing, it is believed that the control circuitry for the machine 10 and the operation of the circuitry, is sufficiently described to be fully understood by those familiar with the design and operation of such machines.

In summary, it is believed that in view of the foregoing, the structure and operation of the invention as hereinbefore described, is completely understood and a summary of the operation thereof is no longer necessary in view of the description hereinbefore set forth. Also, it is believed that in view of the foregoing, it can readily be appreciated that the machine embodying the principles of the instant invention provides a practical and economical machine having enhanced capabilities for rapidly erecting cases without subjecting the cases to damaging effects.

Although the invention has been herein shown and described in what is conceived to be the most practical and preferred embodiment, it is recognized that departures may be made therefrom within the scope of the invention, which is not to be limited to the illustrative details disclosed.

Having described my invention, what I claim as new and desire to secure by Letters Patent is:

1. A case-squaring machine for erecting flattened, knocked-down cases into horizontally open cases preparatory to filling, comprising in combination;

A. means defining a case-squaring station including means for receiving flattened, knocked-down cases and vertically separable pneumatic cups for engaging and vertically expanding the received knocked-down cases into expanded cases of open-end configurations, each of said expanded cases characterized by an upper panel having a horizontal surface, a lower panel having a horizontal surface and leading and trailing side panels having vertical surfaces, and a plurality of articulated flaps including an upper flap and a lower flap extended from said upper and lower panels and adapted to be deflected from the planes of said surfaces, a leading flap and a trailing flap, said leading flap being adapted to be deflected from the plane of the leading surface and said trailing flap being projected in the plane of said trailing side surface when said case is expanded to its open-end configuration, at said case-squaring station;

B. a bottom-feed hopper for supporting a stack of horizontally oriented, flattened, knocked-down cases;

C. means for transferring knocked-down cases from said hopper to said case-squaring station, including horizontally oriented feed roller means disposed in a substantially vertically oriented plane interposed between said hopper and said case-squaring station for transferring to said case-squaring station flattened, knocked-down cases;

D. case picker means including pneumatic picker cups disposed beneath said hopper for serially feeding flattened, knocked-down cases from said hopper to said roller means;

E. case-conveyor means for serially advancing said cases along a case-advancing path extended in a conveyor plane horizontally projected through said machine; and F. means for serially closing one end of each of the expanded cases as they are advanced through said machine including a trailing flap striker assembly comprising:

1. an elevator arm supported at said case-squaring station beneath said track and having one end mounted for pivotal displacement about a horizontal axis;

2. a pivotal striker mounted on said arm opposite said one end; and 3. elevating means including a normally, substantially relaxed chain means for supporting said arm in a vertical plane responsive to a tensioning thereof for imparting upward pivotal displacement to said arm, and means for tensioning said chain for lifting said arm, whereby said pivotal striker is elevated above the plane of said track.

2. A case-squaring machine as defined in claim 1 wherein said pivotal striker includes a bearing, a drive shaft projected vertically through said bearing and supported for oscillating displacement, a striker arm mounted on said shaft and projected horizontally therefrom, a sprocket mounted on said arm and mated with said chain, and gear means coupling said sprocket in driving relation with said drive shaft for imparting angular displacement to the shaft, said chain being responsive to a tensioning thereof for lifting said arm and subsequently driving said sprocket in response to a linear travel thereof in a first direction for imparting a first angular displacement to said shaft, and further chain means for imparting a second angular displacement to said drive shaft, in a direction opposite to said first displacement and for lowering said arm in response to a relaxing of said normally relaxed chain.

3. For use in combination with a case-squaring machine having means for erecting cases characterized by trailing flaps adapted to be in-folded about a vertical axis, a trailing flap striker assembly comprising:

A. an elevator arm supported at said case-squaring station beneath said track and having one end mounted for pivotal displacement about a horizontal axis;

B. a pivotal striker mounted on said arm opposite said one end; and

C. elevating means including a normally, substantially relaxed chain for supporting said arm in a vertical plane responsive to a tensioning thereof for imparting upward pivotal displacement to said arm, and means for tensioning said chain for lifting said arm, whereby said pivotal striker is elevated above the plane of said track.

4. A striker assembly as defined in claim 3 wherein said pivotal striker includes a bearing, a drive shaft projected vertically through said bearing and supported for oscillating displacement, a striker arm mounted on said shaft and projected horizontally therefrom, a sprocket mounted on said arm and mated with said chain, and gear means coupling said sprocket in driving relation with said shaft for imparting oscillation to the shaft, said chain being responsive to a tensioning thereof for lifting said arm and subsequently driving said sprocket in response to a linear travel in a first direction for imparting a first angular displacement to said shaft, and said striker assembly further comprises further chain means for imparting a second angular displacement to said shaft, opposite to said first direction and for lowering said elevator arm in response to a relaxing of said normally relaxed chain.

5. In combination with a case-squaring machine having means for erecting a case characterized by a lower flap and a trailing flap, the improvement comprising:

A. pivotally mounted lower flap-breaking means for downwardly breaking said lower flap including at least one pneumatic cup mounted on a movable manifold, the pneumatic cup adapted to be elevated to grasp said lower flap and to be lowered, while said lower flap is grasped for breaking the flap downwardly;

B. vertically movable, trailing, flap-folding means adapted to be vertically displaced to an operative position as said pneumatic cup is lowered for breaking said flap and horizontally displaced for inward folding, said trailing flap, while in said operative position, and means for displacing the trailing flap-folding means, said trailing flap-folding means being mounted on a lever arm supported for pivotal displacement about a pivotal axis interposed between the ends thereof;

C. connecting means interconnecting said flap-breaking means and said flap-folding means for effecting a breaking of the lower flap, concurrently with a vertical displacement of the trailing flap-folding means to said operative position, said connecting means connected at one end of said lever arm and said flap-folding means being mounted on the other end of the lever arm, said connecting means including a rigid member interconnecting said manifold and said lever arm; and D. an arm actuator for periodically pivotally elevating and lowering said other end of said lever arm, including a first chain means connected to the flap-folding means resiliently supporting the arm against pivotal displacement, and second chain means connected to the flap-folding means for lifting said lever arm in pivotal displacement.

6. An improvement as defined in claim 5 wherein said flap-folding means includes:

a housing mounted on said lever arm, a first drive shaft mounted in said housing and supported thereby in a vertical plane and in angular relation with said lever arm;

means including a second drive shaft mounted in said housing and coupled in driving relation with said first drive shaft;

means for driving said second drive shaft in rotation, including first coupling means for coupling the second drive shaft to said second chain means;

means for impeding rotation of said second drive shaft including second coupling means for coupling said second drive shaft to said first chain means; and a flap-striking arm mounted on said first drive shaft and suppoted thereby in angular relation therewith, said flap-striking arm being periodically elevated to an operational position relative to the trailing flap of the case in response to a tensioning of the second chain means, and subsequently displaced from an initial position into a flap-tucking position, relative to said trailing flap in response to continued tensioning of said second chain means.

7. An improvement as defined in claim 6 wherein said first chain means includes a tension spring for returning said flap-striking arm to its initial position and downwardly displacing said lever arm in response to a relaxing of the tension in said first chain means.

* * * * *

UNITED STATES PATENT AND TRADEMARK OFFICE

CERTIFICATE OF CORRECTION

PATENT NO. : 4,411,642

DATED : October 25, 1983

INVENTOR(S) : Minor E. Gee

It is certified that error appears in the above-identified patent and that said Letters Patent is hereby corrected as shown below:

Column 9, line 33, "not" should read --now --.

Column 9, line 49, "138" should read -- 136 --.

Column 15, line 20, "arcuate" should read -- actuate --.

Column 24, line 50 "hog" should read -- hot --.

Column 32, line 9, "suppoted" should read -- supported --.

Signed and Sealed this

*Eleventh* Day of *September 1984*

[SEAL]

*Attest:*

GERALD J. MOSSINGHOFF

*Attesting Officer*

*Commissioner of Patents and Trademarks*